US011602699B1

(12) United States Patent
Hwang et al.

(10) Patent No.: US 11,602,699 B1
(45) Date of Patent: Mar. 14, 2023

(54) ACTUATION ASSEMBLY FOR A TOY

(71) Applicant: Mattel, Inc., El Segundo, CA (US)

(72) Inventors: Jung Jun Hwang, Inglewood, CA (US); Maxence Rodrigue Bilodeau, Marina Del Rey, CA (US); Gang Zhang, Shen Zhen (CN)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/585,773

(22) Filed: Jan. 27, 2022

(51) Int. Cl.
*A63H 18/02* (2006.01)

(52) U.S. Cl.
CPC ..... *A63H 18/025* (2013.01); *A63H 18/026* (2013.01)

(58) Field of Classification Search
CPC ..... A63H 18/00; A63H 18/16; A63H 18/025; A63H 18/026
See application file for complete search history.

(56) References Cited

U.S. PATENT DOCUMENTS 6,517,007 B2 * 2/2003 Kong ..... A63H 18/026 104/53
7,628,674 B2 * 12/2009 Nuttall ..... A63H 18/026 446/444
7,819,720 B2 * 10/2010 Nuttall ..... A63H 18/028 446/444
8,256,721 B2 * 9/2012 O'Connor ..... A63H 18/028 105/54
9,050,994 B2 * 6/2015 Nuttall ..... B62B 1/22
9,314,703 B2 * 4/2016 Nuttall ..... A63H 18/02
9,707,489 B2 * 7/2017 Nuttall ..... A63H 18/02
2008/0009224 A1 * 1/2008 Nuttall ..... A63H 18/026 446/444
2008/0113585 A1 * 5/2008 Payne ..... A63H 18/02 446/444
2012/0220183 A1 * 8/2012 Payne ..... A63H 18/00 446/14
2015/0181991 A1 * 7/2015 Strong ..... A45B 25/00 135/20.2

* cited by examiner

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

An actuation assembly for a toy includes a first actuation component, a second actuation component, a first lever arm, a second lever arm, and a sequencer. The sequencer is configured to be rotated a first amount in response to actuations of the first actuation component and configured to be rotated a second amount in response to selective actuations of the second actuation component. Rotations of the first amount can actuate the first lever arm, while rotations of the second amount can actuate the first lever arm and the second lever arm. The actuation assembly may be included in a toy vehicle track set that includes a trackway along which toy vehicles can drive.

19 Claims, 19 Drawing Sheets

ACTUATION ASSEMBLY FOR A TOY

FIELD OF THE INVENTION

The present application relates generally to an actuation assembly for a toy, such as a toy vehicle track set with a multi-action play element and/or an actuation mechanism for the same.

BACKGROUND

Conventional toy vehicle track sets include one or more sections of track along which a toy vehicle can travel. In some track sets, accessories will act on a toy vehicle when the toy vehicle reaches the end of a track path (i.e., while the vehicle is stopped). For example, an accessory may move a toy vehicle from the end of one track to the beginning of another. Alternatively, accessories may act on a toy vehicle as a toy vehicle traverses a track. However, the play value of an accessory repeatedly acting on a vehicle in the same manner may be limited. A need exists for a toy vehicle track set that further captures the attention and imagination of a user. Similarly, needs exits for new and unique actuations in various toys, in addition to toy vehicle track sets.

SUMMARY

An actuation assembly, as well as toys and toy vehicle track sets including the same are presented herein. According to some embodiments, an actuation assembly for a toy is presented herein. The actuation assembly includes a first actuation component, a second actuation component, a first lever arm, a second lever arm, and a sequencer. The sequencer is configured to be rotated a first amount in response to actuations of the first actuation component and configured to be rotated a second amount in response to actuations of the second actuation component. Rotations of the first amount can actuate the first lever arm while rotations of the second amount can actuate the first lever arm and the second lever arm. In some instances, an actuation of the first lever arm causes a multi-action play element to execute a first movement pattern and an actuation of the second lever arm causes a multi-action play element to execute a second movement pattern.

According to one some embodiments, a toy vehicle track set is presented herein. In some embodiments, the toy vehicle track set includes a trackway along which toy vehicles can drive, a first actuator, a second actuator, a multi-action play element, and an actuation assembly. The first actuator is disposed at a first location along the trackway and the second actuator is disposed at a second location along the trackway. The multi-action play element is configured to respond to at least some actuations of the first actuator by executing a first play action where the multi-action play element interacts with the trackway in a first manner. Additionally, the multi-action play element is configured to respond to at least some actuations of the second actuator by executing a second play action where the multi-action play element interacts with the trackway in a second manner. The actuation assembly includes a sequencer that randomly controls which actuations of the first actuator cause the multi-action play element to execute the first play action and randomly controls which actuations of the second actuator cause the multi-action play element to execute the second play action.

According to some embodiments, a toy vehicle track set includes a trackway along which toy vehicles can drive, a first actuator, a second actuator, and a multi-action play element. The first actuator is disposed at a first height along the trackway and the second actuator is disposed at a second height along the trackway. The multi-action play element is configured to respond to at least some actuations of the first actuator by executing a first play action where the multi-action play element interacts with toy vehicles disposed on the trackway at or near the first height. Additionally, the multi-action play element is configured to respond to at least some actuations of the second actuator by executing a second play action where the multi-action play element interacts with toy vehicles disposed on the trackway at or near the second height.

Other systems, methods, features and advantages will be, or will become, apparent to one with skill in the art upon examination of the following figures and detailed description. All such additional systems, methods, features and advantages are included within this description, are within the scope of the claimed subject matter.

BRIEF DESCRIPTION OF THE DRAWINGS

The toy vehicle track set presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy vehicle booster. In the figures, like-referenced numerals designate corresponding parts throughout the different views.

DETAILED DESCRIPTION

Overall, an actuation assembly for toys, such as a toy vehicle track set, and a toy vehicle track set including the same are presented herein. The toy vehicle track set includes a multi-action play element that can be actuated in multiple manners. More specifically, the toy vehicle track set includes a plurality of actuators that can cause different actuations of the multi-action play element. For example, actuating different actuators may cause the multi-action play element to execute different play actions that cause the multi-action play element to interact with different portions of a trackway included in the toy vehicle track set. Thus, the multi-action play element may extend or expand an action area for the toy vehicle track set (i.e., the area in which a play element can be used).

At a high-level, the varied play actions are achieved with an actuation assembly that, at a minimum, causes the multi-action play element to execute a first play action in response to at least some actuations of a first actuator and causes the multi-action play element to execute a second play action in response to at least some actuations of a second actuator. Moreover, to increase the play value, an actuation assembly may include a sequencer (i.e., a randomizer) so that only some actuations of actuators cause the multi-action play element to execute a play action. That is, the sequencer may create random actuations. Among other advantages, this may create a play pattern where the multi-action play element can surprise a user (e.g., a child) multiple times during a play sequence, e.g., along the length of a trackway included in the toy vehicle track set. For simplicity, the actuation assembly presented herein is largely described in connection with a toy vehicle track set; however, the actuation assembly can be used with any desirable toys, including doll houses, games, action figure play sets, etc. Thus, an description of the actuation assembly provided in the context of a toy vehicle track set should not understood to be limiting in any manner.

Figure 1:
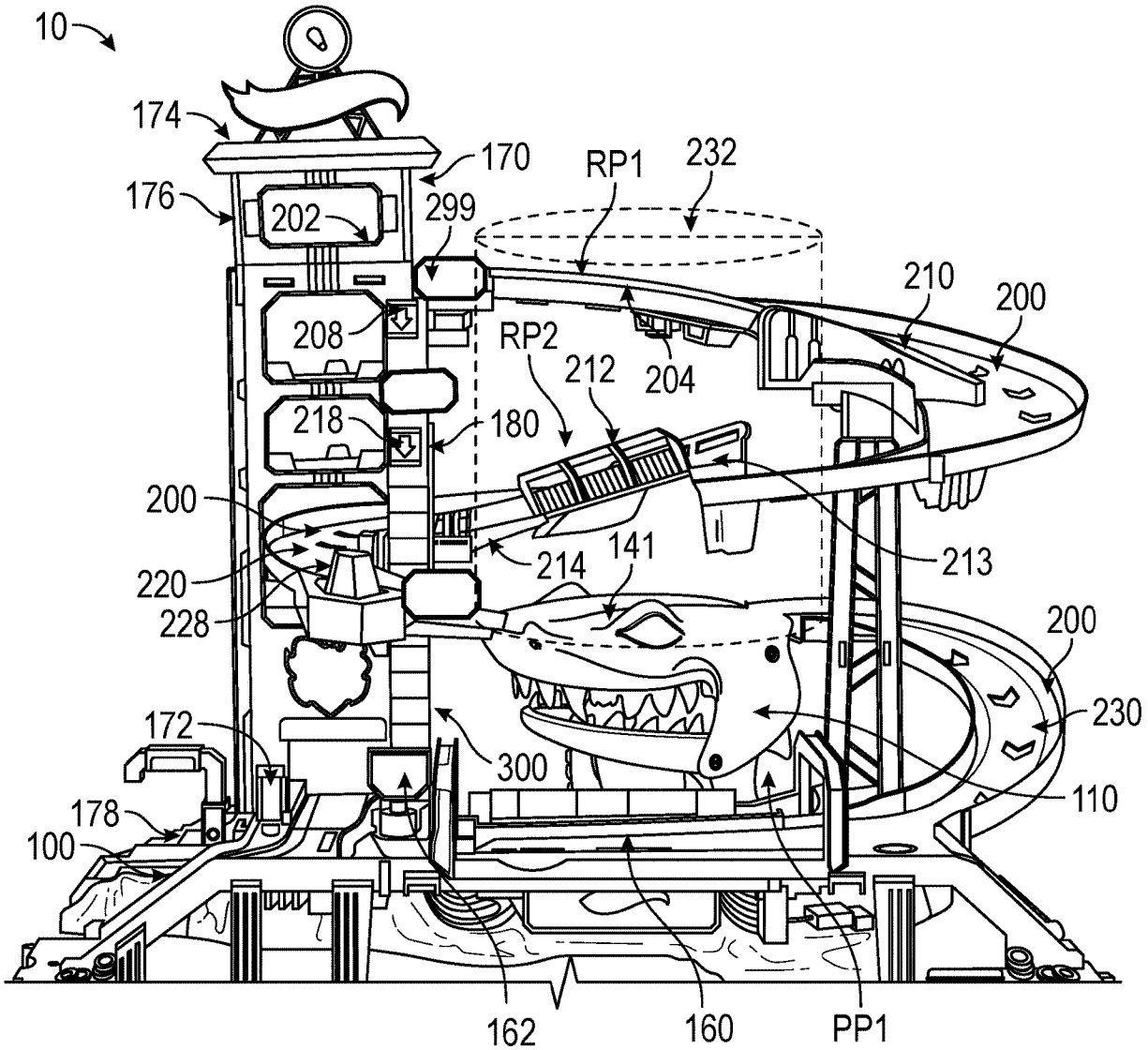
FIG. 1 illustrates a front perspective view of a toy vehicle track set with a multi-action play element formed in accordance with an example embodiment of the present application.

FIG. 1 illustrates an example embodiment of a toy vehicle track set 10 that executes the techniques presented herein. As can be seen, the toy vehicle track set 10 includes a base 100 on which a multi-action play element 110 is mounted. A tower 170 also extends vertically (i.e., longitudinally upwards), from a bottom 172 disposed on base 100 to a top 174, and a trackway 200 spans at least a portion of the height of the tower 170. In the depicted embodiment, the trackway 200 also extends through and around the tower 170 as the trackway spirals downwards from a starting point 202 to the base 100. Specifically, the starting point 202 of trackway 200 is disposed in or adjacent tower 170 and exits a first side 180 of the tower 170. Then, the trackway 200 curves through the tower 170, entering from a back side 184 (see FIG. 2) of the tower and exiting from a front side 182 (see FIG. 2) of the tower 170. However, in other embodiments, the trackway 200 need not be connected to, extend through, and/or extend around a tower 170. In fact, in other embodiments, the toy vehicle track set 10 need not include a tower 170 (nor does it need to include a base 100). For example, the toy vehicle track set could include a trackway 200 supported by stanchions or other such supports.

Figure 2:
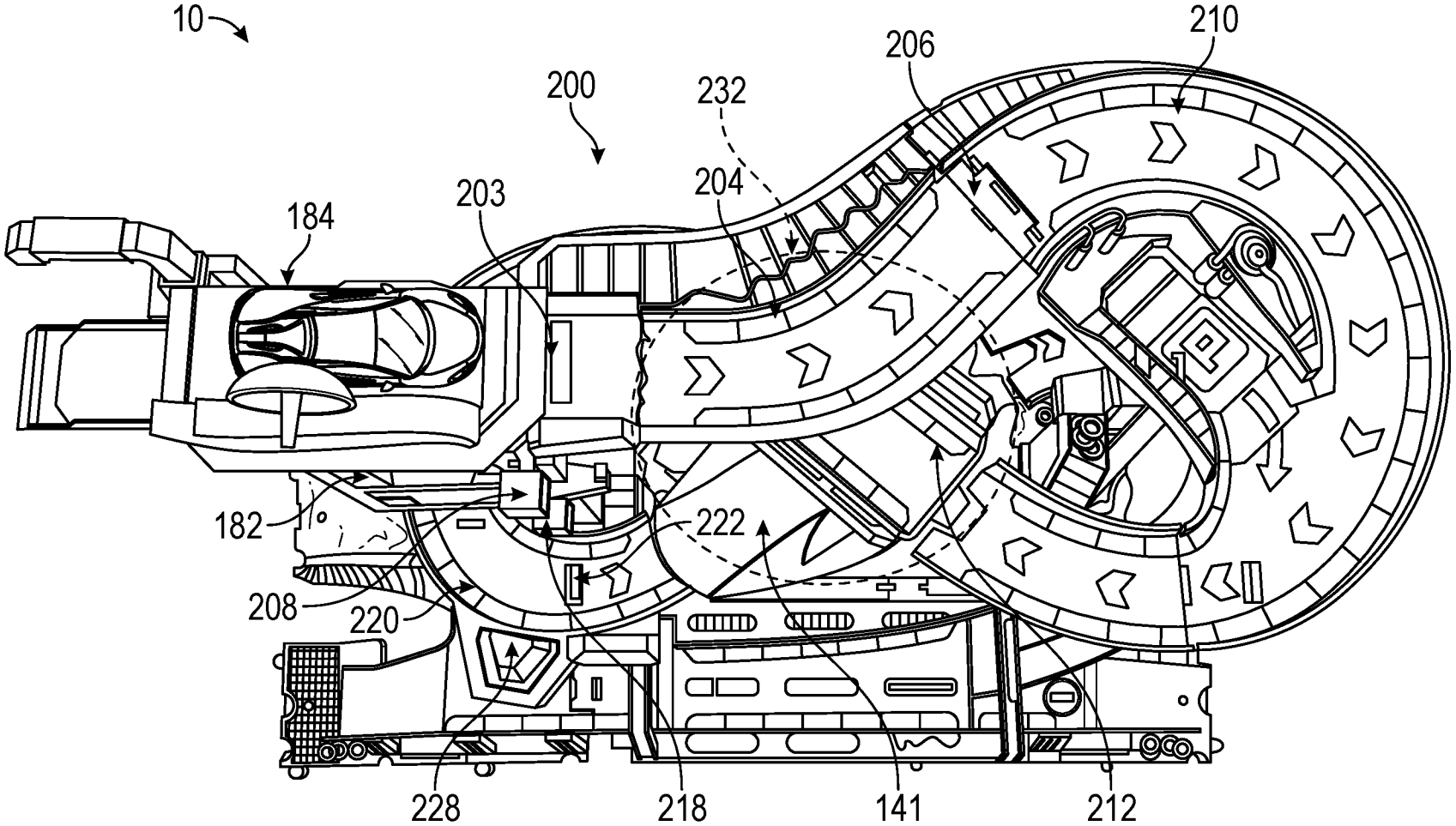
FIG. 2 illustrates a top, perspective view of the toy vehicle track set of FIG. 1

Still referring to FIG. 1, but now in combination with FIG. 2, regardless of how the trackway 200 is supported, at least a portion of trackway 200 generally encircles a central opening 232 above the multi-action play element 110. To illustrate this concept, FIGS. 1 and 2 depict central opening 232 as a dashed line cylinder; however, to be clear, this is merely representative and the central opening 232 need not be cylindrical. In fact, the central opening 232 need not be any one particular shape and can be irregular and/or vary over different dimensions. In any case, the central opening 232 provides a passageway or channel through which the multi-action play element 110 may move to interact with different portions of trackway 200. Thus, portions of trackway 200 disposed exteriorly of the central opening 232 may be fixed or stationary while portions of trackway 200 disposed within (or at least partially within central opening 232) may be movable to allow the multi-action play element 110 to move therethrough.

More specifically, in the depicted embodiment, the trackway 200 includes a first movable track portion 204 that connects the starting point 202 with a first stationary track section 210 and a second movable track portion 212 (also referred to herein as bridge 212) that connects the first stationary track section 210 with a second stationary track section 220. Additionally, the trackway 200 includes a third stationary track section 230 that can be selectively connected to the second stationary track section 220 via a track section 141 defined atop the multi-action play element 110 when the multi-action play element 110 is in a rest position PP1.

As can be seen best in FIG. 2, each of the first stationary track section 210, second stationary track section 220, and third stationary track section 230 are disposed exteriorly of the central opening 232. Thus, these stationary tracks will not impede movement of the multi-action play element 110 through the central opening 232. On the other hand, the first movable track portion 204 and the bridge 212 are both movable out of the central opening 232, for example, in response to an impact from the multi-action play element 110 moving through the central opening 232. In the depicted embodiment, movable track portions 204 and 212 are both pivotable about their distal or downstream ends, insofar as "downstream" indicates an end that is further along a one-way (i.e., downhill) track than an opposite or "upstream" end.

More specifically, the first movable track portion 204 includes a pivot 206 that extends laterally across a downstream end of the first movable track portion 204. This allows a proximal end of the first movable track portion 204 (i.e., the end adjacent starting point 202) to move upwards in response to the multi-action play element 110 (or anything else) impacting an underside of the first movable track portion 204. Likewise, the second movable track portion 212 includes a pivot 214 that extends laterally across a downstream end of the second movable track portion 212. Again, this allows a proximal end of the second movable track portion 212 (i.e., the end adjacent the first stationary track section 210) to move upwards in response to the multi-action play element 110 (or anything else) impacting an underside of the second movable track portion 212. However, in other embodiments, any track portions extending through central opening 232 may be movable in any manner.

Notably, and still referring to FIGS. 1 and 2, when the second movable track portion 212 is in a rest position RP2, the second movable track portion 212 forms a stop 213 that prevents a toy vehicle from traveling continuously from first stationary track section 210 onto second movable track portion 212. That is, the second movable track portion 212 can control when a toy vehicle enters second movable track portion 212. On the other hand, when the first movable track portion 204 is in a rest position RP1, the first movable track portion 204 forms a continuous track path between the starting point 202 and the first stationary track section 210. Thus, the starting point 202 includes a gate 203 that can selectively retain toy vehicles to control when toy vehicles enter the first movable track portion 204 (notably, in FIG. 2, a toy vehicle is shown sitting atop the top 174 of tower 170, while gate 203 may retain a toy vehicle disposed in tower 170). Similarly, second stationary track section 220 may include a gate 222 that that can selectively retain toy vehicles to control when toy vehicles enter the track section 141 defined on a portion of the multi-action play element 110.

Generally, each of gate 203, stop 213, and gate 222 may be actuated by an actuation of actuation mechanism 300 included in an actuation assembly 299 that is incorporated into the toy vehicle track set. Thus, gate 203, stop 213, and gate 222 may each be actuated at the same time that the multi-action play element 110 is actuated (even if only one of, or a subset of, gate 203, stop 213, and gate 222 is actuated per actuation). Consequently, gate 203, stop 213, and gate 222 will release toy vehicles into the central opening 232 as or slightly after—depending on a slope of the trackway and/or a distance between the gate/stop and the central opening 232—the play element 110 executes a play action (e.g., moves), causing the multi-action play element 110 to interact with toy vehicles to create interesting play patterns and/or add play value.

In the depicted embodiment, the actuation assembly 299 includes separate actuators for gate 203, stop 213, and gate 222, with a first actuator 208 able to actuate gate 203, a second actuator 228 able to actuate gate 222, and a third actuator 218 able to actuate stop 213 (i.e., able to move bridge 212). As is generally denoted in FIG. 1, in the depicted embodiment, the actuation mechanism 300 is generally included on the first side 180 of the tower 170 and other elements of the actuation assembly 299 are included on or in the base 100. Thus, in the depicted embodiment, each of the actuators 208, 218, and 228 is disposed on or near the first side 180 of tower 170, in or on which the remainder of actuation mechanism 300 is included. This ensures that the first actuator 208 is positioned at or adjacent a first location on the trackway 200, the second actuator 228 is positioned at or adjacent a second location on the trackway 200, and the third actuator 218 is positioned at or adjacent a third location on the trackway 200. More specifically, the first actuator 208 is disposed at a first height along the trackway, the second actuator 228 is disposed at a second height on the trackway that is lower than the first height, and the third actuator 218 is disposed therebetween.

This height distribution may ensure that the actuators are adjacent the trackway 200 at different heights and, thus, may create actuations at different heights, creating play value along a large vertical span of the trackway 200. The height distribution may also evenly distribute gate/stop actuators along the height of a the trackway 200 so that toy vehicles attempting to traverse the trackway 200 are frequently stopped for a crossing of the central opening 232 that may or may not result in actuation of the multi-action play element 110. However, in other embodiments, the actuation assembly 299 may be on, in, or connected to any portion of the toy vehicle track set other embodiments may include any arrangement of actuators and stops/gates (or other such features) and these features may be interconnected by any linkages to facilitate different placements, play patterns, play actions, etc.

Figure 3:
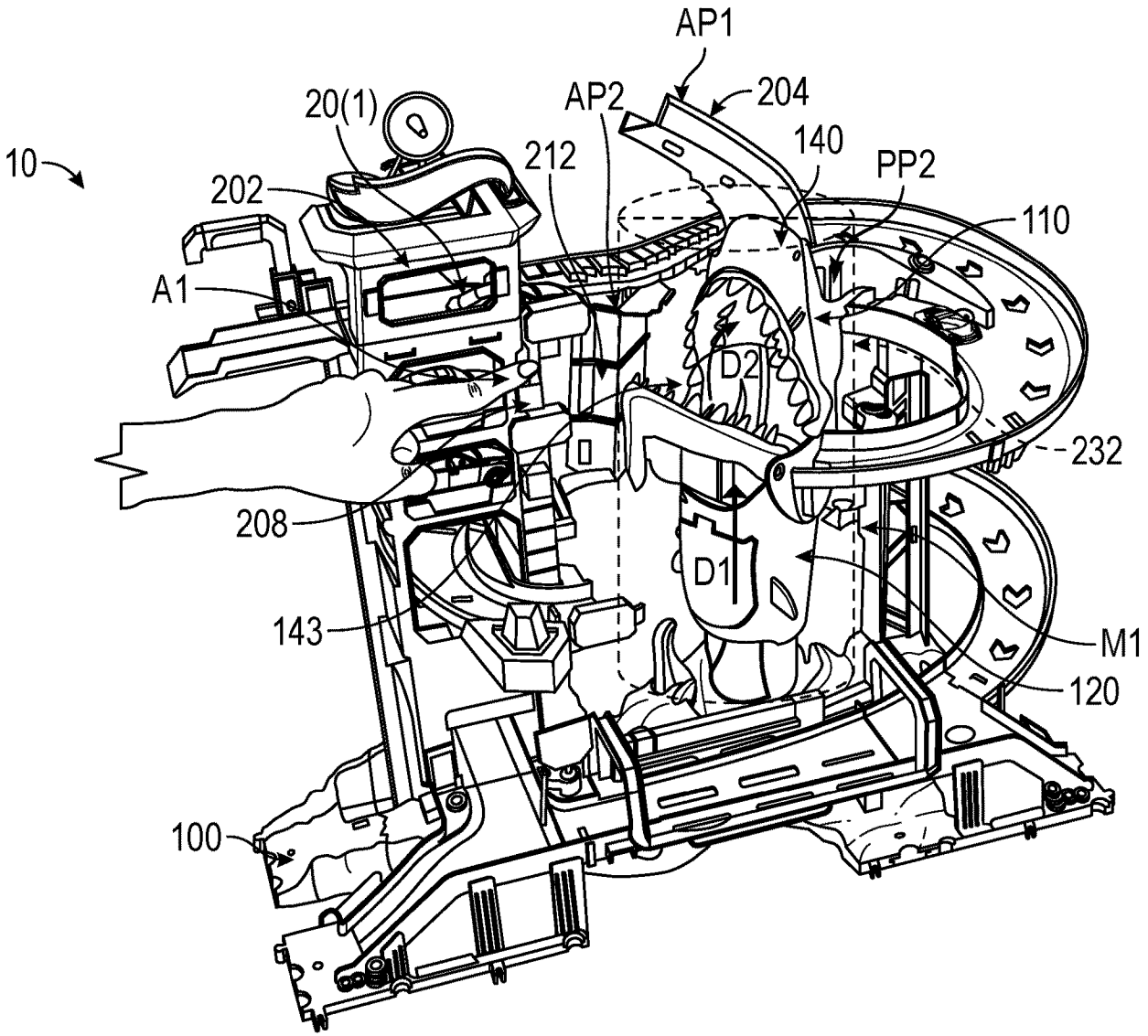
FIGS. 3-6 illustrate front, perspective views of the toy vehicle track set of FIG. 1 with toy vehicles in different positions and/or during different actuations of the multi-action play element, according to example embodiments.

Now referring to FIG. 1 in combination with FIG. 3, the toy vehicle track set 10 presented herein may also include additional features/components that work with, supplement, or replace a portion of the features discussed above. As two examples, the depicted embodiment includes an elevator 178 that extends along the first side 176 of the tower 170 and a master switch assembly 160 disposed on and in the base 100. The elevator 178 can move toy vehicles from the base 100 (or from a support surface on which the base 100 is resting) to different positions on the trackway 200 and/or in the tower 170, for example, to position toy vehicles adjacent gate 203, stop 213, and/or gate 222. Meanwhile, the master switch assembly 160, which is described in further detail below, may include an actuator 162 and may generally function to turn the multi-action play element 110 "on" or "off" That is, after an actuation of actuator 162, actuators 208, 218, and 228 might not trigger multi-action play element 110. Put yet another way, if the master switch assembly 160 "turns the multi-action play element 110 off," the multi-action play element 110 will not be able to execute a play action (i.e., will not move).

In some of these embodiments, "turning the multi-action play element 110 off," may also prevent actuation of gate 203, stop 213, and/or gate 222, thereby encouraging a user to reset the multi-action play element 110 before driving another toy vehicle down trackway 200. Alternatively, "turning the multi-action play element 110 off," may not prevent actuation of gate 203, stop 213, and/or gate 222 and, thus, may allow a user to use trackway 200 without interaction/interference from multi-action play element 110. Still further, in some instances, a user can "turn off" the multi-action play element 110, gate 203, stop 213, and gate 222 and use trackway 200 in an "open play" mode where the trackway has no obstructions, stops, or gates. However, to be clear, master switch assembly 160 and elevator 178 need not be included in the toy vehicle track set 10 and are representative of additional features that may supplement the unique action of the multi-action play element 110. Thus, other embodiments can include one, none, or both of these features, either alone or in combination with other additional elements.

Now turning to FIGS. 3-6, but with continued reference to FIG. 1 as well, these figures depict the toy vehicle track set 10 with toy vehicles and/or the multi-action play element 110 in different positions in order to depict the full play pattern created by the combination of features/structures included in toy vehicle track set 10. Overall, FIGS. 3-6 show toy vehicles proceeding down the trackway 200 in a somewhat predetermined play pattern. However, this is just an example and a user need not use the toy vehicle track set 10 in this exact manner. That is, in use, a user can place toy vehicles on any portion of trackway 200 and/or actuate any actuator at any time. Thus, any use of "first actuation," "second actuation," or the like does not mean that actuations must proceed in a specific order. Instead, the terms first, second, etc., are used for descriptive purposes only.

With that in mind, in FIG. 3, the toy vehicle track set 10 is shown after a first actuation A1 of the first actuator 208 causes the multi-action play element 110 to execute a first play action M1 (i.e., a first motion M1). As is explained in further detail below, in at least some embodiments, only selective actuations (e.g., random or sequenced actuations) of first actuator 208 will cause the multi-action play element 110 to execute a first play action M1. Regardless, when the multi-action play element 110 executes a first play action M1, it moves from a rest position PP1 (i.e., first position PP1, as shown in FIG. 1) to an actuated position PP2 (i.e., second position PP2). More specifically, to complete the first play action M1, a first portion 120 of multi-action play element 110 moves generally upwards in direction D1 through the central opening 232 while a second portion 140 of multi-action play element 110 rotates upwards in direction D2, moving into and/or extending within central opening 232. One or both of these movements cause the multi-action play element 110 to impart upward forces to the first movable track portion 204 and the second movable track portion 212. In turn, these upward forces move the first movable track portion 204 from a rest position RP1 (see FIG. 1) to an actuated position AP1 and move the second movable track portion 212 from a rest position RP2 (see FIG. 1) to an actuated position AP2.

Figure 4:
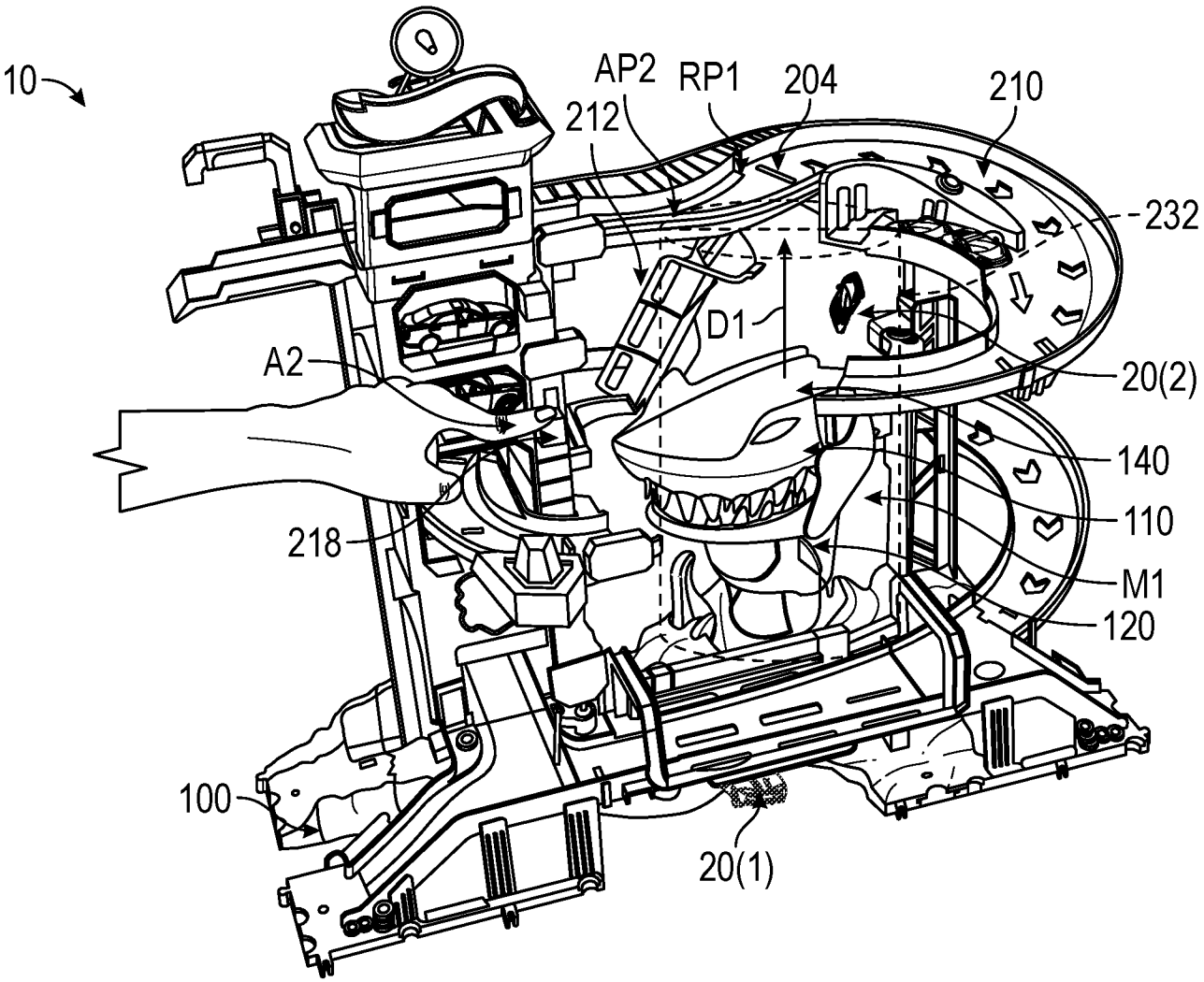
Figure 5:
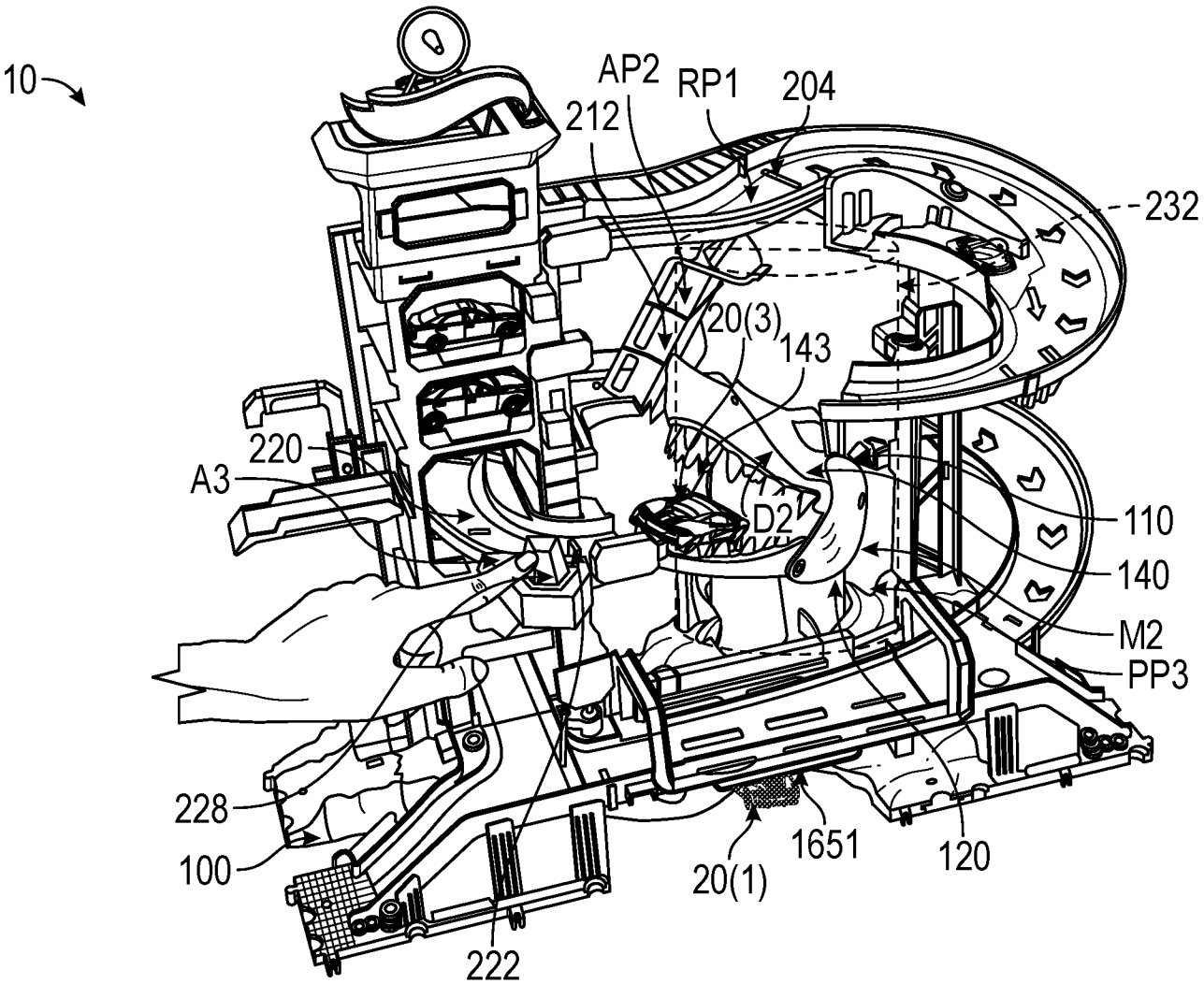
Figure 6:
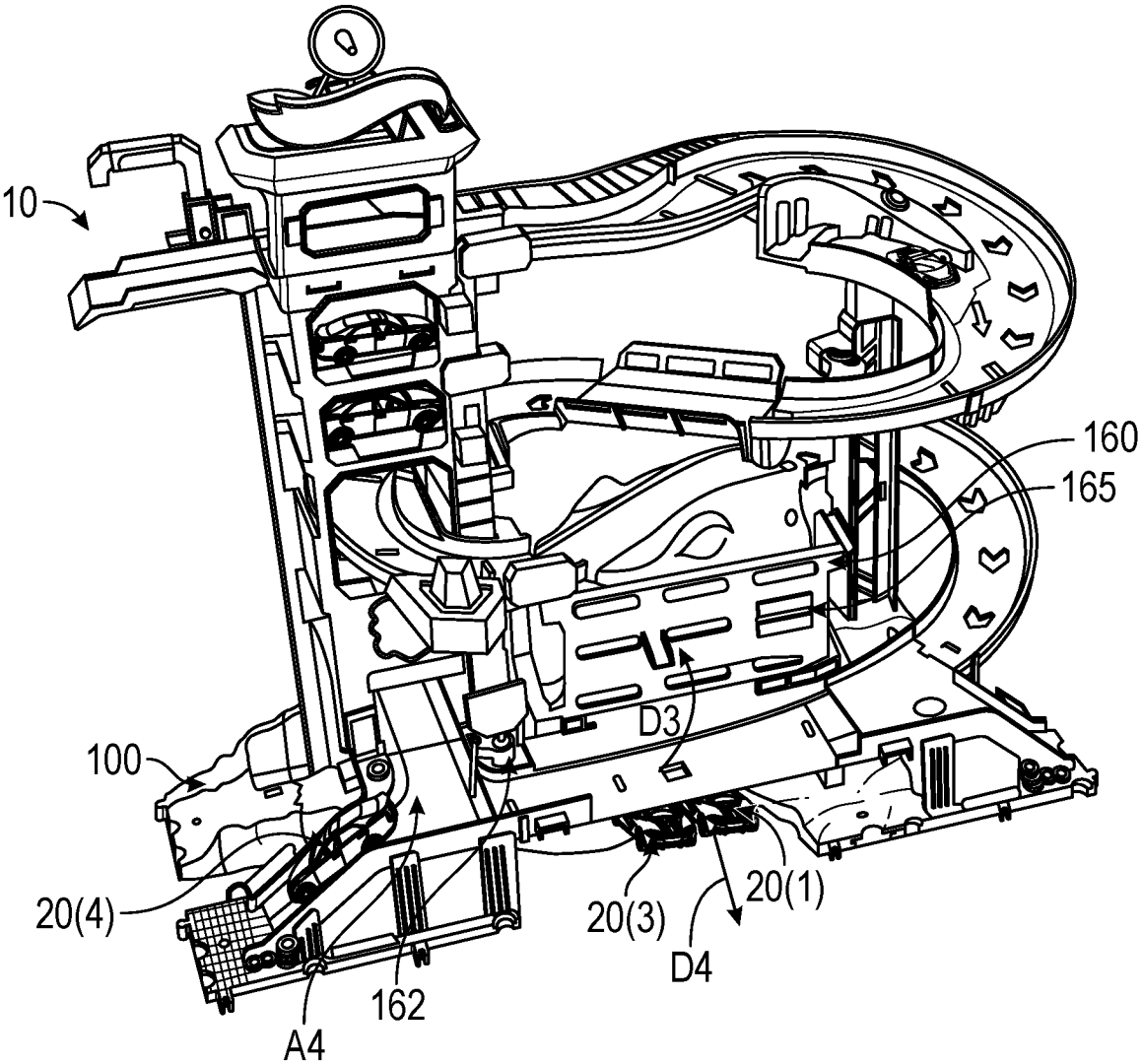

In FIG. 3, a first toy vehicle 20(1) was held in place at the starting point 202 by gate 203 before actuation A1 caused the multi-action play element 110 to execute the first play action M1. Thus, the actuation A1 released the gate 203 while also causing the multi-action play element 110 to execute the first play action M1. However, by the time the first toy vehicle 20(1) exits gate 203 and reaches the first movable track portion 204, the multi-action play element 110 displaces the first movable track portion 204 from its rest position RP1 so that the first movable track portion 204 is not available as a track surface (i.e., will not form a continuous driving pathway). Consequently, the first toy vehicle 20(1) will fall into the central opening 232, potentially falling within the multi-action play element 110. In fact, in at least some embodiments, the multi-action play element 110 may be designed to align an opening 143 beneath the displaced track portion 204 when executing play action M1 so that the multi-action play element 110 can "capture" a toy vehicle 20(1) exiting gate 203. FIGS. 4-6, which show progressions of a play pattern that starts in FIG. 3, show the first toy vehicle 20(1) "captured" beneath multi-action play element 110 (and beneath base 100).

Alternatively, in different embodiments, the multi-action play element 110 and/or trackway 200 may be designed so that, when the multi-action play element 110 executes the first play action M1, the multi-action play element 110 impacts the first movable track portion 204 while the first toy vehicle 20(1) is disposed on the first movable track portion 204 (i.e., as the first toy vehicle 20(1) drives across the first movable track portion 204). Timing the impact as such may launch the first toy vehicle 20(1) off the first movable track portion 204 and away from toy vehicle track set 10. In any case, although not shown, if additional vehicles were disposed at stop 213 or gate 222, the actuation of actuator 208 may or may not release these vehicles. Vehicles released from stop 213 and/or gate 222 might be held in place by the extended multi-action play element 110 or actuated in the manner described below in connection with FIGS. 4 and 5.

FIG. 4 also depicts the multi-action play element 110 executing the first play action M1 (i.e., a first motion M1) in response to an actuation A2 of the third actuator 218. However, now, a second toy vehicle 20(2) was resting against stop 213 (i.e., on a downstream end of first stationary track section 210) prior to initiation of the first play action M1. As is illustrated, when the second toy vehicle 20(2) is in this position, the second toy vehicle 20(2) reaches the second movable track portion 212 as the second movable track portion 212 is displaced from its rest position RP2. That is, when the multi-action play element 110 impacts the underside of the second movable track portion 212, the impact causes the second movable track portion 212 to move towards its actuated position AP2 (the arrow for AP2 is shown dashed in FIG. 4 since second movable track portion 212 has moving towards position AP2 in FIG. 4). This, in turn, launches the second toy vehicle 20(2) off the second movable track portion 212, away from toy vehicle track set 10.

Notably, in the depicted embodiment, the second toy vehicle 20(2) is launched while the first toy vehicle 20(1) is captured within the multi-action play element 110. This is because the second toy vehicle 20(2) enters the central opening 232 from an opposite side of the central opening 232 as compared to the first toy vehicle 20(1). That is, in the depicted embodiment, the first toy vehicle 20(1) and the second toy vehicle 20(2) enter opposite sides of central opening 232 when released from gate 203 and stop 213, respectively, and, thus, interact with the multi-action play element 110, which opens towards side, in different manners. Accordingly, in FIG. 4, the first toy vehicle 20(1) is shown beneath the base 100, "captured" by the multi-action play element 110, while the second toy vehicle 20(2) is shown being launched in the air away from the toy vehicle track set 10.

Moreover, in the precise moment depicted in FIG. 4, the upward movement of the second portion 140 of the multi-action play element 110 in direction D1 has moved the second movable track portion 212 out of its rest position RP2, but has not yet moved first movable track portion 204 out of its rest portion RP1. This is because FIG. 4 depicts the multi-action play element 110 during motion M1, before motion M1 is complete. However, in other embodiments, an actuation A2 of actuator 218 might only cause the second portion 140 of the multi-action play element 110 to move in direction D1, without causing the second portion 140 of the multi-action play element 110 to rotate upwards in direction D2. That is, in other embodiments, FIG. 4 could depict an entire play action/motion. In either case, a toy vehicle 20(2) resting on stop 213 may be launched off the second movable track portion 212 or otherwise involved in a play pattern (e.g., toy vehicle 20(2) might also fall into the multi-action play element 110) when an actuation A2 of actuator 218 causes the multi-action play element 110 to execute a play action. But, to be clear, when an actuation A2 of actuator 218 causes the multi-action play element 110 to execute a play action, the first movable track portion 204 does not necessarily need to be moved out of its rest position RP1.

Now turning to FIG. 5, this Figure depicts the multi-action play element 110 executing a second play action M2 (i.e., a second motion M2) that is different from the first play action M1. The multi-action play element 110 executes the second play action M2 in response to selective actuations A3 of actuator 228, one of which is depicted in FIG. 5. As shown, the second play action M2 involves a portion, but not the entirety, of the motion executed during play action M1. More specifically, when the multi-action play element 110 executes the second play action M2, the second portion 140 of the multi-action play element 110 pivots in direction D2 without accompanying longitudinal movement from the first portion 120 of the multi-action play element 110 in direction D1. Thus, the multi-action play element 110 executes a movement pattern in which the multi-action play element 110 moves to a second actuated position PP3. The second actuated position PP3 extends a smaller distance (i.e., smaller height) through the central opening 232 than the first actuated position PP2 and, thus, creates a unique interaction for cars exiting gate 222 (i.e., on a downstream end of second stationary track section 220). By comparison, the first actuated position PP2 (at the completion of play action M1) interacts with toy vehicles on different (e.g., higher) portions of trackway 200.

Prior to the particular moment depicted in FIG. 5, a third toy vehicle 20(3) was resting against gate 222 (i.e., on a downstream end of second stationary track section 220). Then, the actuation A3 of actuator 228 released gate 222 and caused the multi-action play element 110 to execute the second play action M2. As is illustrated, in this scenario, the third toy vehicle 20(3) reaches the downstream end of the second stationary track section 220 as the second portion 140 of the multi-action play element 110 pivots open in direction D2, which opens opening 143. Consequently, the multi-action play element 110 can capture the third toy vehicle 20(3)—e.g., in the same manner the multi-action play element 110 captures the first toy vehicle 20(1) at or near first movable track portion 204.

Generally, FIGS. 3-5 depict how the actuation assembly 299 of the toy vehicle track set 10 can create a unique play pattern that allows the multi-action play element 110 to interact with toy vehicles as they move down the trackway 200. In the depicted embodiment, this provides interactions at different heights. In short, this is achieved with a sequencer that causes only certain actuations of certain actuators to actuate the multi-action play element 110 and, in some cases, only when actuations are in a certain order. For example, in some instances, the first actuator 208 and/or the third actuator 218 must be actuated before an actuation of the second actuation 228 can cause the multi-action play element 110 to execute a play action (e.g., play action M2).

Additionally or alternatively, the first actuator 208 may need to be actuated before an actuation of the third actuator 218 can cause the multi-action play element 110 to execute a play action (e.g., play action M1). Still further, in some instances, the first actuator 208 and the third actuator 218 must be actuated, in any combination, two to five times before an actuation of the second actuator 228 can cause the multi-action play element 110 to execute a second play action (e.g., play action M2). At least some of these play patterns may encourage a user to move a vehicle along trackway 200 (e.g., down the trackway 200) from start to finish and experience all play actions of the multi-action play element 110. Still further, some play patterns may be truly random and the actuation assembly 299 may randomly actuate the multi-action play element 110 in response actuations of actuators 208, 218, and 228.

However, to reiterate, the terms "first," "second," and third" are only used to simplify the description of the depicted embodiments and in no way denote a specific order or play action. That is, in this application, actuator 228 is described as a second actuator since it causes a second play action M2 while actuator 218 is described as a third actuator 218 since it may repeat the play action M1 of actuator 208; but, in different instances, the parts or components of set 10 need not be described with the same sequencing terminology. For example, in some instances, actuator 228 may be described as a third actuator because, moving from a start or top of trackway 200 to a bottom or end of trackway 200, actuator 228 is third in line. From such a perspective, actuator 218 can be described as a second actuator.

Regardless of the play pattern, after the multi-action play element 110 completes a play action (e.g., play action M1 or M2), the multi-action play element is reset. For example, the multi-action play element 110 may need to be manually reset. Once the multi-action play element 110 is reset, a user can reposition toy vehicles on the trackway 200 and try another actuation to advance their toy vehicles along the trackway 200. In at least some embodiments, the sequencer of the actuation mechanism 300 (of actuation assembly 299) may ensure that successive actuations of the same actuator do not both cause the multi-action play element 110 to execute a play action. Thus, after the multi-action play element 110 interacts with a track section to prevent a toy vehicle from traversing that track section, a user may try the same actuator again to release a toy vehicle from an associated stop/gate, and successfully "advance" their toy vehicle past this track section. Additionally or alternatively, the actuation assembly 299 may be configured to periodically allow actuations of a pattern of actuators (e.g., moving from top to bottom along trackway 200) to open gates/stops without causing the multi-action play element 110 to execute a play action so that a toy vehicle can periodically advance through the entire trackway 200 without interruption.

Now turning to FIG. 6, if a user completes a play pattern shown in FIGS. 3-5 (e.g., by executing actuations A1, A2, and A3 sequentially), two toy vehicles—toy vehicles 20(1) and 20(3)—may be captured by the multi-action play element 110 before any toy vehicles reach the base 100. This is illustrated in FIG. 6. However, as mentioned above, the toy vehicle track set 10 depicted in the figures also includes a fourth actuator 162 that can further enhance the play pattern offered by the track set 10 and "release" any "captured vehicles." The release is achieved by unlocking and pivoting a main body 165 of the master switch assembly 160, which, in turn, rotates in direction D3 to remove a blocker 1651 from the path of the captured vehicles and/or impart a force to the rear of the captured vehicles. Consequently, actuation of actuator 162 can cause or allow the captured vehicles to move in direction D4 and "escape" the toy vehicle play set 10 (and the multi-action play element 110 in which they were captured). In the depicted embodiment, the actuator 162 can be actuated when a fourth toy vehicle 20(4) travels along the base 100 (e.g., after fully traversing the trackway 200) and pushes the actuator 162 to create a fourth actuation A4.

Figure 7:
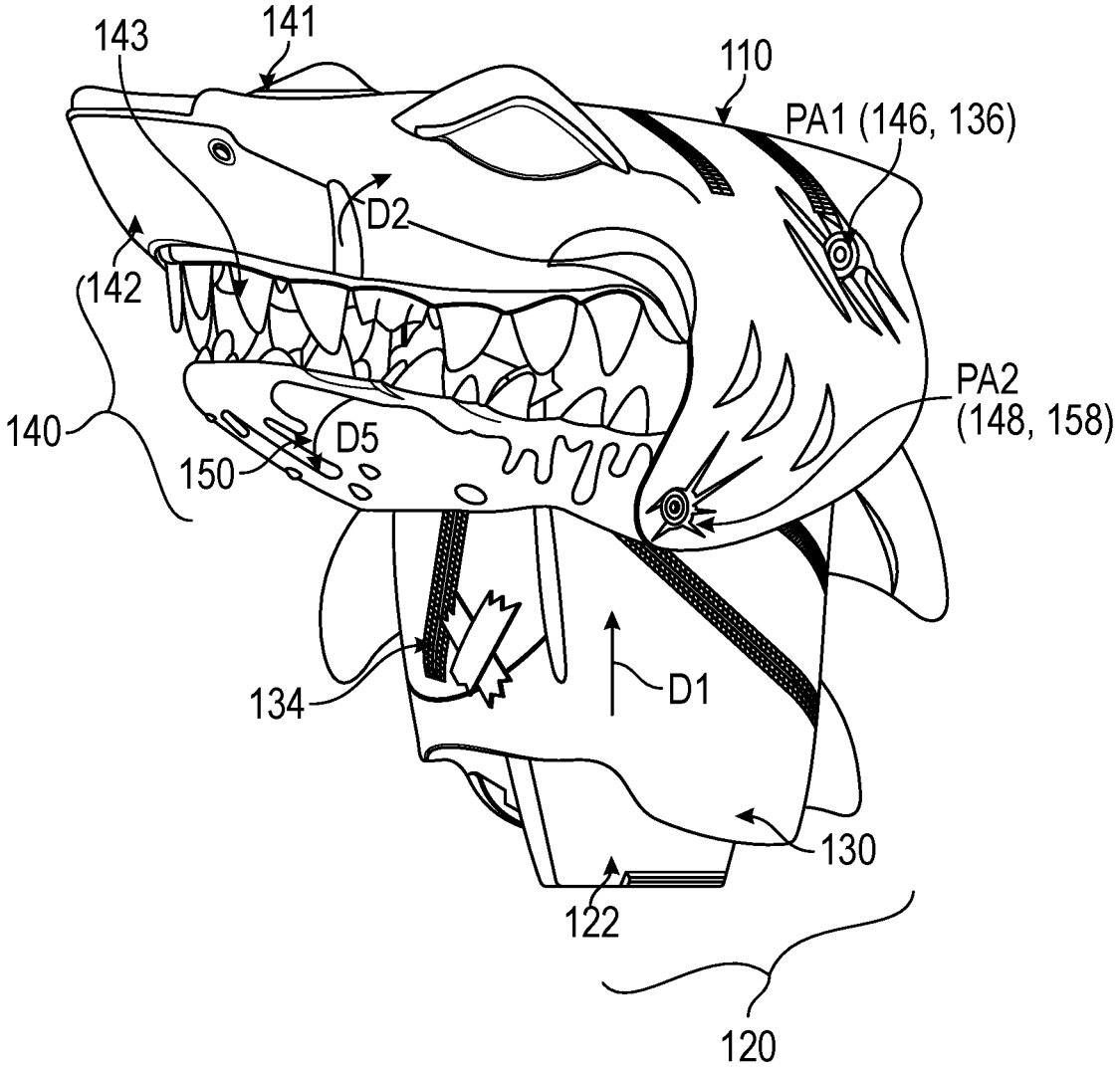
FIG. 7 illustrates a side perspective view, form a first side, of the multi-action play element included in the toy vehicle track set of FIG. 1, according to an example embodiment.
Figure 8:
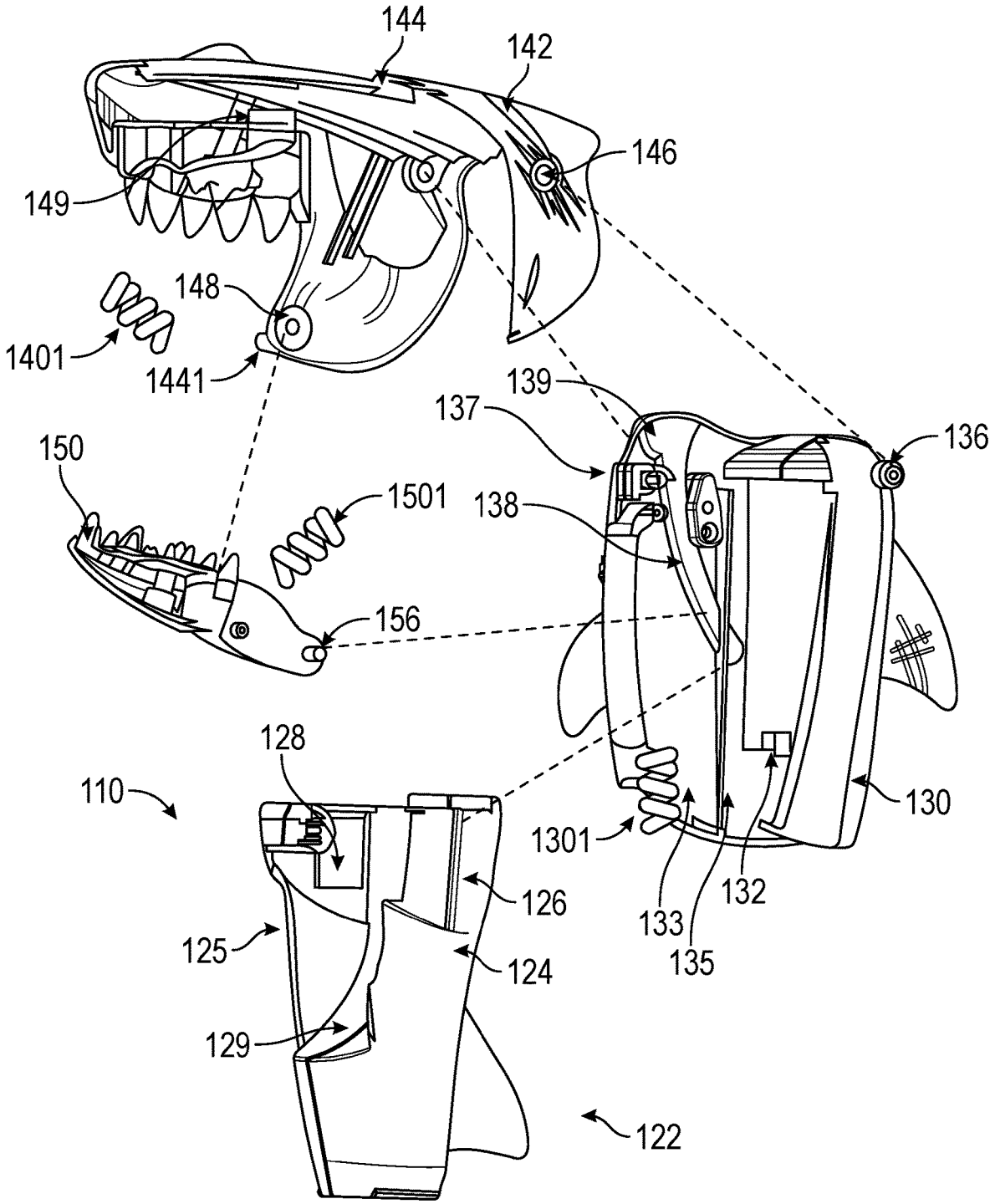
FIG. 8 illustrates side, sectional views of partially exploded components of the multi-action play element of FIG. 7.
Figure 9:
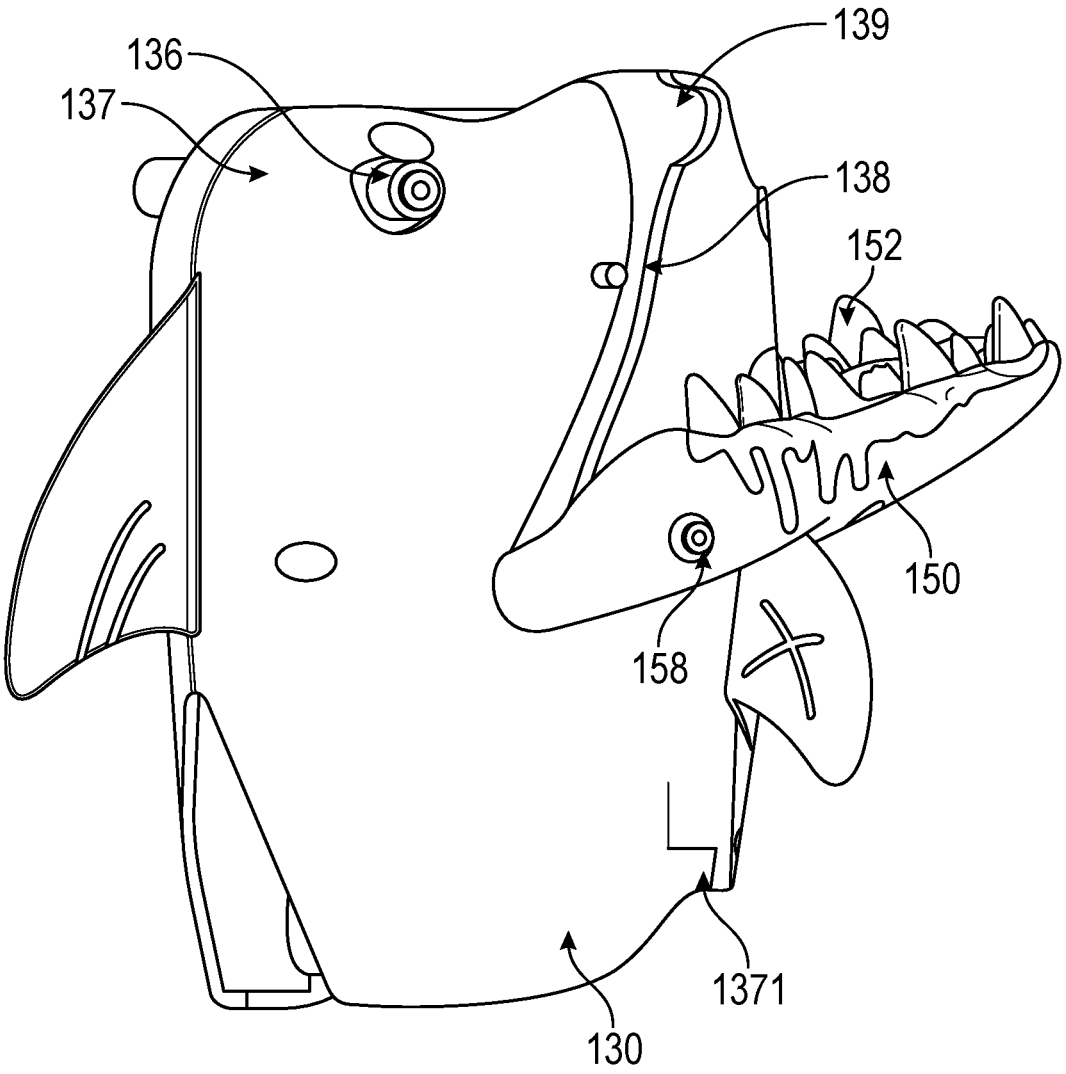
FIG. 9 illustrates a side view, from a second side, of components of the multi-action play element of FIG. 7.

Now turning to FIG. 7-9 for a more detailed description of the multi-action play element 110. As mentioned above, the multi-action play element 110 generally includes a first portion 120 and a second portion 140. In the depicted embodiment, the first portion 120 is formed from a stationary body 122 and a movable body 130 while the second portion 140 is formed from a first member 142 and a second member 150. Portions 120 and 140 are each described in further detail below; however, to be clear, these two-part constructions are examples of one manner of forming a multi-action play element 110 and a multi-action play element 110 can also be formed in a multitude of other manners with any number or combination of components.

With that said, the first portion 120 of the depicted embodiment includes a stationary body 122 and a movable body 130 that is movable along the stationary body 122 to cause the multi-action play element 110, or at least the first portion 120, to move in direction D1 (and to allow for a reset). In the depicted embodiment, the stationary body 122 includes an exterior surface 124 with a track 126 and the movable body 130 includes an interior surface 133 with a rider 135 that can ride along the track 126 to guide movement of the movable body 130 with respect to the stationary body 122. The movable body 130 may also include a biasing member 1301 (e.g., a compression spring) that can drive movement along the path defined by the track 126 and rider 135. Additionally, the movable body 130 may define a flange 1371 (see FIG. 9) that can be retained by a lever arm to resist the forces of biasing member 1301, as is described in further detail below.

The stationary body 122 may include an open front 125 that is aligned with a sloped interior surface 129 disposed within an interior cavity 128 of the stationary body 122. The movable body 130 may also define an interior cavity 132 that is at least partially aligned with the interior cavity 128 of the stationary body 122. Collectively, these features may allow a toy vehicle that is "captured" by the multi-action play element 110 to travel through the first portion 120. Moreover, in at least some embodiments, the movable body 130 may include an exit flap 134 that can selectively cover the open front 125 so that toy vehicles can exit the first portion 120 regardless of whether the movable body 130 is raised or lowered on the stationary body 122.

Still referring to FIGS. 7-9, the second portion 140 of the multi-action play element 110 is movably coupled to the first portion 120 to allow the second portion 140 to move with respect to the first portion 120. More specifically, in the depicted embodiment, the second portion 140 of the multi-action play element 110 can pivot about an axis PA1 that extends through the second portion 140 and the first portion 120 to move with respect to the first portion 120. That is, the second portion 140 can pivot about pivot axis PA1 in direction D2 to pivot "upwards." Since the major dimension (i.e., largest dimension) of the second portion 140 extends laterally when the second portion 140 is in a rest position, pivoting in an upwards direction D2 will increase the overall height of the multi-action play element 110. However, other embodiments need not include such dimensions (and, thus, will not extend the overall height of the multi-action play element 110 by rotating). In at least some embodiments, the second portion 140 may include a biasing member 1401 (e.g., a compression spring) that can drive rotational movement about pivot axis PA1 in direction D2. Additionally, the main body 144 may define a flange 1441 that can be retained by a lever arm to resist the forces of biasing member 1401, as is described in further detail below.

In the depicted embodiment, a main body 144 of the first member 142 (of the second portion 140) includes first receivers 146 configured to engage at least one boss 136 included on an exterior surface 137 of the movable body 130 (of the first portion 120) to form or define the rotational axis PA1. Meanwhile, the main body 144 of the first member 142 (of the second portion 140) includes second receivers 148 configured to engage bosses 158 included on an exterior surface of the second member 150 (of the second portion 140) to form a second rotational axis PA2. With these two rotational axes, the first member 142 can, either alone or together with the second member 150 rotate or pivot about the first portion 120 in direction D2.

Additionally or alternatively, the second member 150 can rotate or pivot about a portion of the first member 142 in direction D5 (about pivot axis PA2). However, this rotation may be controlled via an additional linkage so that the overall movement between second member 150 and second portion 140 (i.e., movement of second member 150 in direction D5) is coordinated and/or controlled (e.g., delayed) with respect to pivoting/rotational movement of the second portion 140 in direction D2. More specifically, in the depicted embodiment, the second member 150 is connected to the first member 142 at pivot axis PA2, but is also connected to the movable body 130 of the first portion 120 along a track 138 defined in the exterior surface 137 of the movable body 130.

As can be seen in at least FIG. 8, the track 138 includes an enlarged portion 139 disposed at or near a top of the movable body 130. When the protrusion 156 is movably secured in the track 138, the track 138 will guide the protrusion 156 along a path that causes the second member 150 to rotate with the second portion 140 until the protrusion reaches the enlarged portion 139. When the protrusion 156 reaches the enlarged portion 139, the protrusion 156 will decouple rotation of the interior second member 150 from rotational movement of the first member 142 and allow the second member 150 to rotate around pivot axis PA2. Then, natural forces (e.g., due to a moment created by a weight of the second member 150 and the force of gravity) or forces generated by a biasing member (e.g., biasing member 1501) may drive rotation of the second member 150 in direction D5.

Notably, when the second member 150 rotates or pivots about PA, the first member 142 and second member 150 may expose or create opening 143 therebetween. More specifically, the second member 150 may include an interior surface 152 while the first member 142 includes an interior surface 149 positioned to oppose the interior surface 152. Thus, when the second member 150 pivots about axis PA2 in direction D5, the interior surface 152 may pivot away from the interior surface 149 and create the opening 143 therebetween. In at least some embodiments, the opening 143 connects to the interior cavity 132 of the movable body 130. Consequently, a toy vehicle entering the opening 143 can fall through the second portion 140 and into the first portion 120 of the multi-action play element 110, perhaps falling beneath or adjacent the multi-action play element 110 via sloped interior surface 129 and/or open front 125 of the stationary body 122 (of the first portion 120 of the multi-action play element 110).

Figure 10:
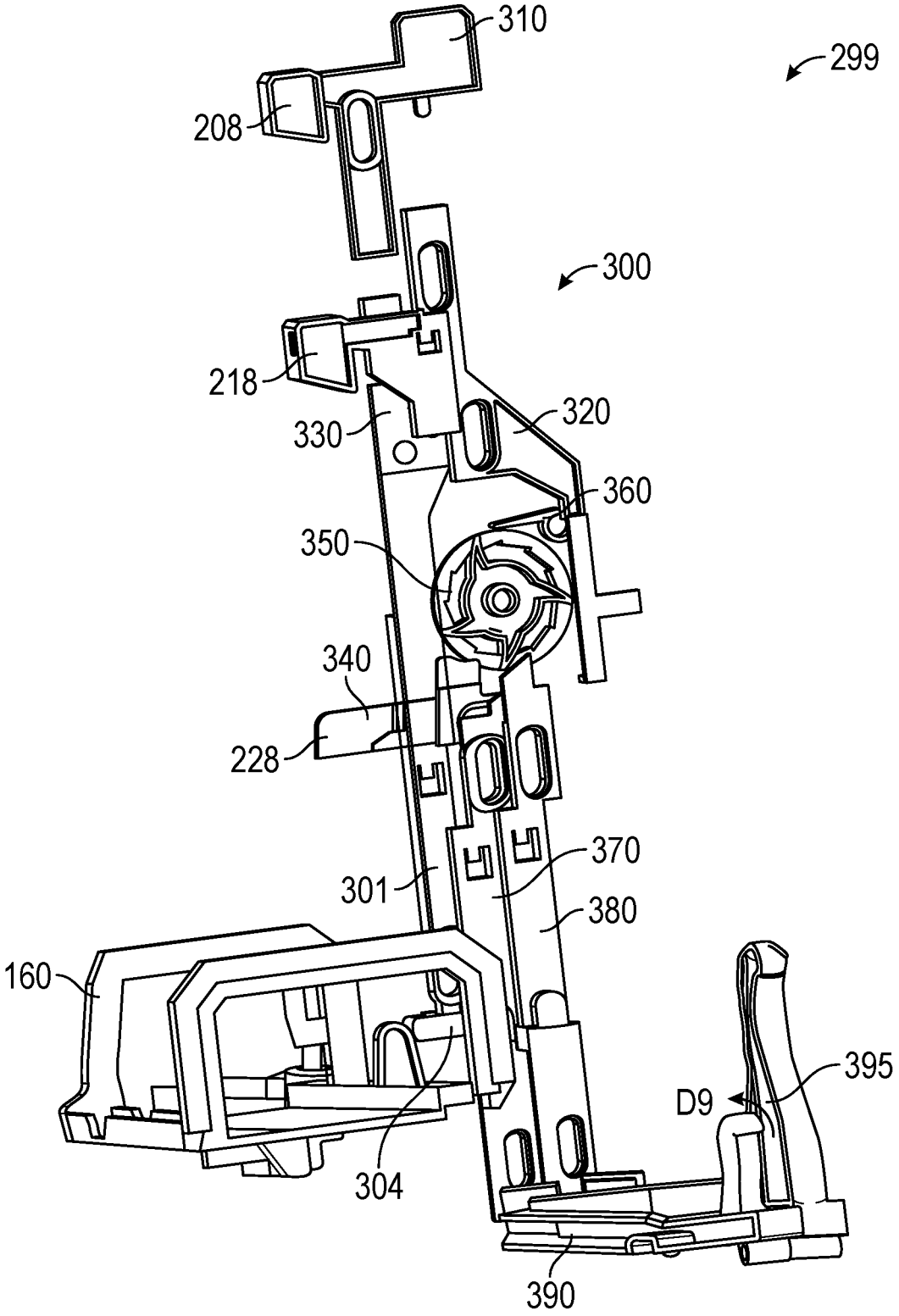
FIG. 10 illustrates a front perspective view of the actuation assembly included in the toy vehicle track set of FIG. 1, according to an example embodiment.
Figure 11:
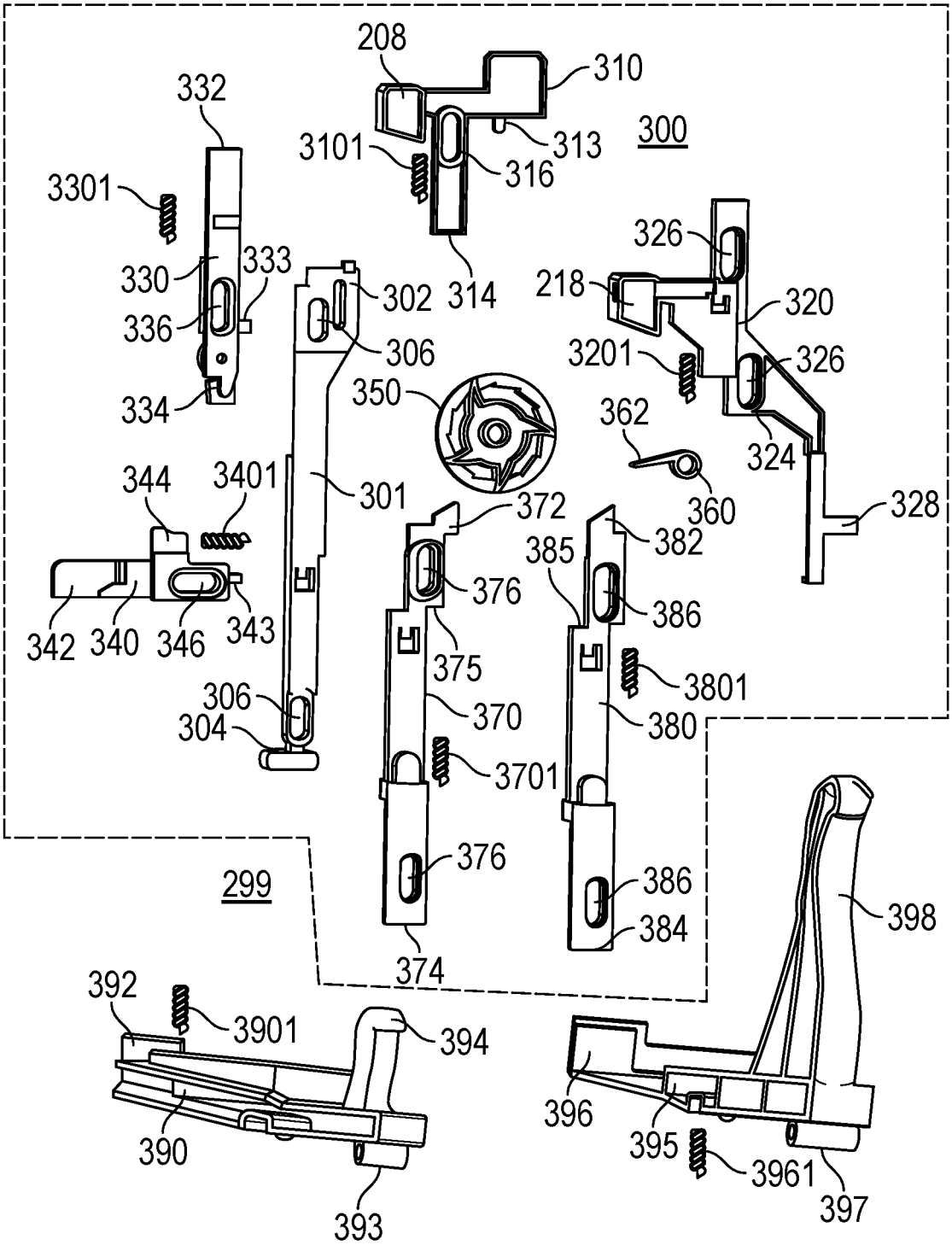
FIG. 11 illustrates an exploded view of components included in an actuation assembly of FIG. 10, at least some of which form an actuation mechanism.
Figure 12A:
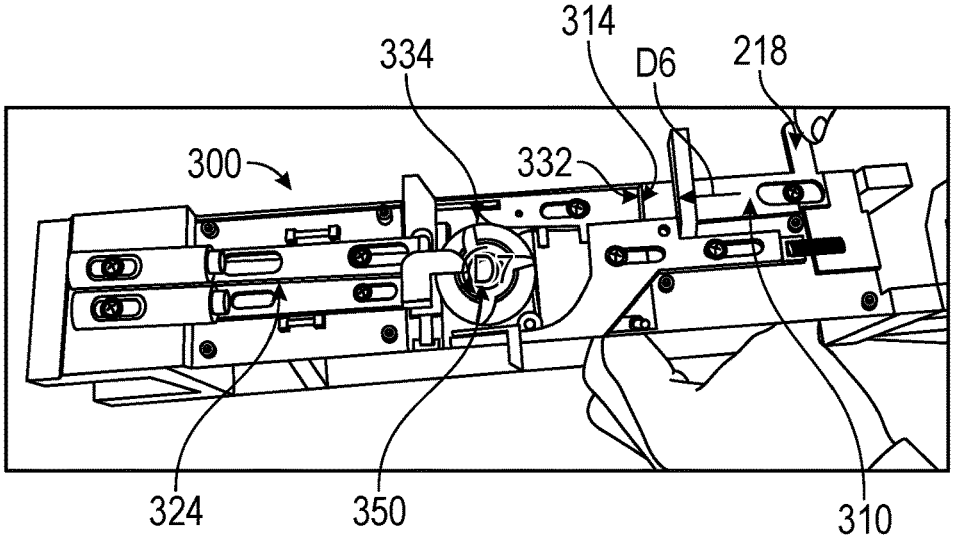
FIGS. 12A-12C illustrate front perspective views of the actuation mechanism of FIG. 11 during different actuations.
Figure 12B:
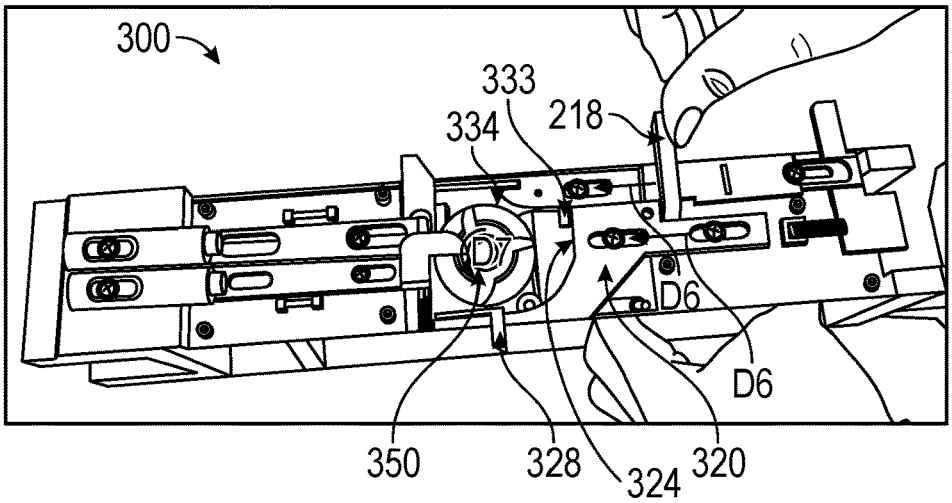
Figure 12C:
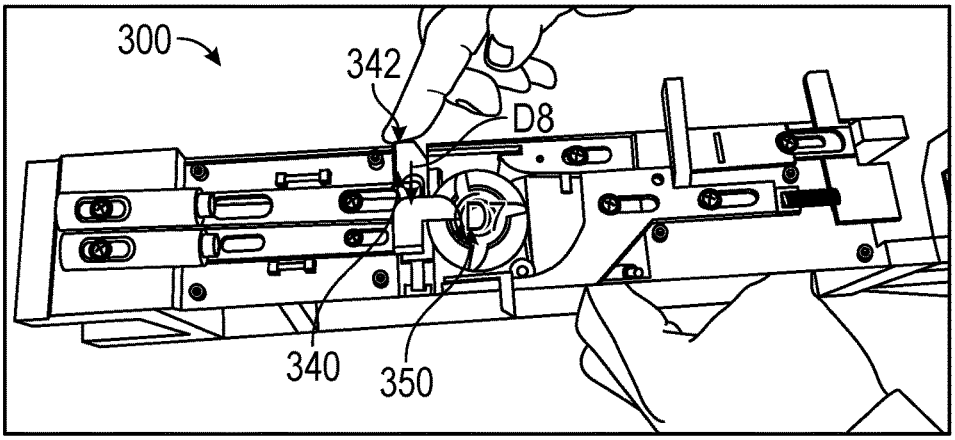

Now turning to FIGS. 10-12C, these Figures depict an actuation assembly 299 included in the toy vehicle track set 10 presented herein, or at least portions thereof. As mentioned, this actuation assembly 299 is representative of an actuation assembly that may included any desirable toy, such as a doll house or play set of any type, to provide unique actuation and/or play patterns. In FIG. 10, the actuation assembly 299 is fully assembled. Meanwhile, FIG. 11 shows components of the actuation assembly 299, including an actuation mechanism 300, exploded and FIGS. 12A-12C depict the actuation mechanism 300 during various actuations. As can be seen in FIG. 10, when the actuation assembly 299 is fully assembled, the actuation mechanism 300 interacts with the master switch assembly 160, a first play element linkage 390, and a second play element linkage 395. However, at least because the actuation mechanism 300 is the primary driver of motion/play action in the toy vehicle track set 10, the foregoing description of FIGS. 10-12C focuses on the actuation mechanism 300. Then, the master switch assembly 160, the first play element linkage 390, and the second play element linkage 395 are described thereafter in connection with latter figures.

At a high-level, the actuation mechanism 300 includes a first actuation component 310 that includes and/or is configured to be actuated by the first actuator 208, a second actuation component 340 that includes and/or is configured to be actuated by the second actuator 228, and a third actuation component 320 that includes and/or is configured to be actuated by the third actuator 218. In response to an actuation, each of actuation components 310, 320, and 340 act on a sequencer 350 that can selectively actuate a first lever arm 370 and/or a second lever arm 380. In turn, lever arms 370 and 380 can trigger one or both of first play element linkage 390 and second play element linkage 395 to cause the multi-action play element 110 to execute different play actions (e.g., play action M1 or play action M2). In the depicted embodiment, actuation component 340 directly engages the sequencer 350 while the first actuation component 310 and the third actuation component 320 engage the sequencer 350 via linkage 330, as is described in detail below.

First, in the depicted embodiment, the first actuation component 310 includes actuator 208, a first actuation cam 314, and a longitudinal opening 316, all of which can be seen in FIG. 11. The longitudinal opening 316 is configured to guide movement of the first actuation component 310 along a longitudinal axis. Thus, as is illustrated in FIG. 12A, when the first actuator 208 is actuated in direction D6 (e.g., by way of a user depressing the first actuator 208 longitudinally downwards), the entire first actuation component 310 will move longitudinally in direction D6. As a result, the first actuation cam 314 engages a first actuation surface 332 of the linkage 330 and drives the linkage 330 longitudinally in direction D6.

Like the first actuation component 310, the linkage 330 includes a longitudinal opening 336 that is configured to guide movement of the linkage 330 along a longitudinal axis. Thus, when the first actuation cam 314 of the first actuation component 310 moves the first actuation surface 332 of linkage 330 longitudinally in direction D6, the entire linkage 330 will move longitudinally in direction D6 (again, shown in FIG. 12A). As can be seen in FIG. 11, while the first actuation surface 332 is disposed at one end of the linkage 330, an actuation cam 334 is disposed at the other end (also shown in FIG. 13A, among other Figures). Thus, when the actuation mechanism 300 is fully assembled, the actuation cam 334 is positioned adjacent to the sequencer 350 and longitudinal actuations of the linkage 330 in direction D6 can cause the actuation cam 334 to engage and advance the sequencer 350 in rotational direction D7.

Still referring to FIGS. 10-12C, the third actuation component 320 may also interact with the sequencer 350 by causing a downwards movement of the linkage 330 in direction D6. However, instead of interacting with the first actuation surface 332, the third actuation component 320 may include a second actuation cam 324 that engages a second actuation surface 333 of the linkage 330. More specifically, the third actuation component 320 includes one or more longitudinal openings 326 and a bottom surface that defines the second actuation cam 324. The longitudinal openings 326 are configured to guide movement of the third actuation component 320 along a longitudinal axis. Thus, as is shown in FIG. 12B, a depression of actuator 218 causes the third actuation component 320 to move longitudinally in direction D6 to engage second actuation surface 333 and drive the linkage 330 longitudinally in direction D6. In turn, this causes actuation cam 334 to engage and advance the sequencer 350 in rotational direction D7.

As can be seen in FIG. 11, in at least some embodiments, the first actuation component 310, the third actuation component 320, and the linkage 330 include biasing element 3101, biasing element 3201, and biasing element 3301, respectively. These biasing elements may bias each of the first actuation component 310, the third actuation component 320, and the linkage 330 to rest positions (e.g., the positions shown in FIG. 10). Thus, a depression of the first actuator 208 or the actuator 218 will only temporarily move/depress the linkage 330 and subsequent actuations of actuator 208 or actuator 218 can move linkage 330 from its rest position to an actuated position (along direction D2) where it engages and advances the sequencer 350.

Moreover, in the depicted embodiment, the first actuation component 310 includes a gate actuator 313 configured to actuate the gate 203 included at starting point 202 while the third actuation component 320 includes a track actuator 328 configured to actuate the bridge 212. The interplay between track actuator 328 and bridge 212 is described in further detail below, but, notably, since gate 203 and bridge 212 are tied to actuations of the actuation mechanism 300, actuations of these components will be tied to (i.e., coordinated with) actuations of the multi-action play element 110. Moreover, when first actuation component 310 and second actuation component 340 are spring-biased, an actuation of first actuator 208 or actuator 218 will only temporarily release/actuate gate 203 or bridge 212 and, thus, may only allow a specific number of cars to move along the trackway 200 (e.g., one car at a time through each gate/stop).

Still referring to FIGS. 10-12C, the second actuation component 340 is similar to first actuation component 310 and third actuation component 320 in that an actuation of this component can cause an actuation of sequencer 350. However, there are at least two differences. First, in the depicted embodiment, the second actuation component 340 does not include an actuator integrally formed therewith. Instead, as is shown in FIG. 11, the second actuation component 340 includes an actuation surface 342 that is configured to translate laterally in response to a depression of the second actuator 228.

Second, instead of actuating the sequencer 350 via a linkage, the second actuation component 340 directly engages the sequencer 350. More specifically, and as can be seen in at least FIGS. 11 and 12C, the second actuation component 340 includes an actuation cam 344 that is configured to directly engage and advance sequencer 350. Importantly, the actuation cam 344 may be configured to engage a different portion of the sequencer 350 than is engaged by actuation cam 334 (e.g., in response to longitudinal movements of first actuation component 310 or third actuation component 320). Thus, actuation cam 344 may cause different actuations of the sequencer 350 than then actuation cam 334. Moreover, at least because actuation cams 334 and 344 engage different portions of sequencer 350, some actuations of actuation cam 344 and/or actuation cam 334 may not advance sequencer 350. Each of these aspects is described in further detail below, but before turning to them, the components of the second actuation component 340 are more fully described.

In particular, in addition to the actuation surface 342 and the actuation cam 344, the second actuation component 340 also includes: (1) a lateral opening 346; (2) a biasing element 3401; and (3) a gate actuator 343. As is illustrated in FIG. 12C, the lateral opening 346 may guide movement of the second actuation component 340 in lateral direction D8 (e.g., in response to an actuation of actuator 228) so that the actuation cam 344 can attempt to engage and advance the sequencer 350 in rotational direction D7. Meanwhile, the biasing element 3401 may reset the second actuation component 340 to a rest position (e.g., like biasing element 3101) and the gate actuator 343 may actuate gate 222 (e.g., in the same manner as gate actuator 313). In fact, any description of biasing elements and/or gate actuators included herein in connection with first actuation component 310, third actuation component 320, and/or linkage 330 may be applicable to gate actuator 343 and/or biasing element 3401 and, for brevity, is not reiterated here.

This far, the description of FIGS. 10-12C has described components of the actuation mechanism 300 that may be collectively or individually described as "input component (s)." This is because each of these components converts a user actuation into a potential actuation of sequencer 350. However, to be clear, the above-described input components are merely examples and, in different embodiments, the actuation mechanism 300 may include any number of actuation components that engage the sequencer 350 directly or indirectly (e.g., via one or more linkages). Additionally, each of the actuation components can be configured to move in response to an actuation of actuator in any manner, regardless of whether the actuator is integrated into the actuation component or not (e.g., like first actuation component 310 or second actuation component 340).

Still referring to FIGS. 10-12C, the actuation mechanism 300 may also include "output components" that respond to certain actuations of the sequencer 350. Specifically, in the depicted embodiment, the actuation mechanism 300 includes a first lever arm 370 and a second lever arm 380. The first lever arm 370 extends from an activation cam 372 to a striker 374 and includes one or more longitudinal openings 376 disposed therebetween to guide movement of the first lever arm 370 along a longitudinal axis. Similarly, the second lever arm 380 extends from an activation cam 382 to a striker 384 and includes one or more longitudinal openings 386 disposed therebetween to guide movement of the second lever arm 380 along one or more longitudinal axes. Additionally, and importantly, in the depicted embodiment, the first lever arm 370 has a shoulder 375 that sits in a seat 385 defined by the second lever arm 380. As is discussed in further detail below, the shoulder 375 and seat 385 may cause the second lever arm 380 to travel longitudinally in direction D6 with the first lever arm 370 when the first lever arm 370 is actuated. In at least some embodiments, the first lever arm 370 and/or the second lever arm 380 also have a biasing element 3701 and a biasing element 3801, respectively, to reset lever arms 370 and 380 (individually or together) to rest positions after an actuation by sequencer 350.

Notably, when the striker 374 moves downward, it can actuate the first play element linkage 390. Similarly, when the striker 384 moves downward, it can actuate the second play element linkage 395. In the depicted embodiment, the first play element linkage 390 and the second play element linkage 395 are both pivotable about axes disposed distally from activation cams 372 and 382, respectively—with first play element linkage 390 pivotable about pivot 393 and second play element linkage 395 pivotable about pivot 397. Thus, when the striker 374 moves downward, it impacts an impact area 392 of the first play element linkage 390 and causes a retaining element 394 of the first play element linkage 390 to rotate in direction D9 (see FIG. 10), away from the multi-action play element 110. Likewise, when striker 384 moves downward, it impacts an impact area 396 of the second play element linkage 395 and causes a retaining element 398 of the second play element linkage 395 to rotate in direction D9 (see FIG. 10), away from the multi-action play element 110. In at least some embodiments, play element linkages 390 and 395 include biasing elements 3901 and 3961, respectively. These biasing elements may be configured to bias play element linkages 390 and 395 to a rest position in which the play element linkages 390 and 395 can retain portions of multi-action play element 110 in their rest or non-actuated positions (e.g., so that the multi-action play element 110 remains in its rest position PP1).

Still referring to FIGS. 10-12C, but now with a focus on FIGS. 10 and 11, in addition to the foregoing output and input components, the actuation mechanism 300 may also include a master switch 301 and a rotational limiter 360. The rotational limiter 360 includes a resilient finger 362 that can engage the sequencer 350 in a manner that allows rotation in direction D7 while also selectively preventing rotation in a direction opposite rotational direction D7. Thus, the rotational limiter 360 may assist in ensuring that actuations of actuators 208, 218, and 228 selectively cause the multi-action play element 110 to execute play actions, as is described in further detail below. Meanwhile, the master switch 301 extends from a top end 302 to a foot 304 and includes longitudinal openings 306 therebetween that guide motion of the master switch 301 along a longitudinal axis. As is also described in further detail below (e.g., in connection with FIGS. 18-19), an actuation of the master switch 301 may prevent actuation components 310, 320, and/or 340 from acting on (e.g., engaging and advancing) the sequencer 350. In fact, in some instances, actuation of the master switch 301 may prevent actuation components 310, 320, and 340 from even attempting to act on the sequencer 350.

Figure 13A:
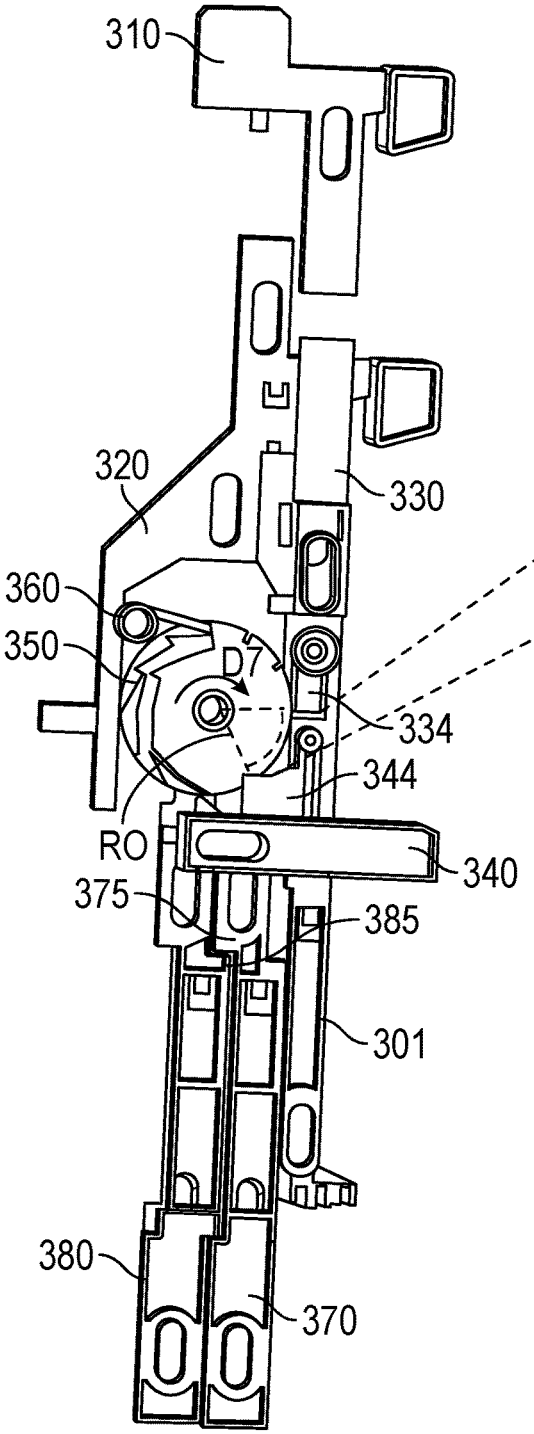
FIGS. 13A and 14A illustrate back and front views, respectively, of the actuation mechanism of FIG. 11, according to an example embodiment.
Figure 13B:
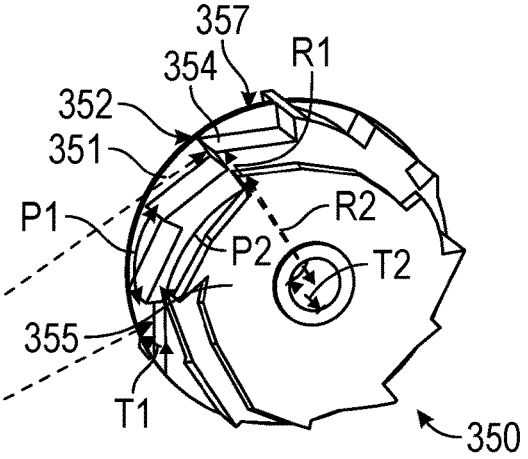
FIGS. 13B and 14B illustrate back and front views, respectively, of a sequencer included in the actuation mechanism of FIG. 11, according to an example embodiment.
Figure 14A:
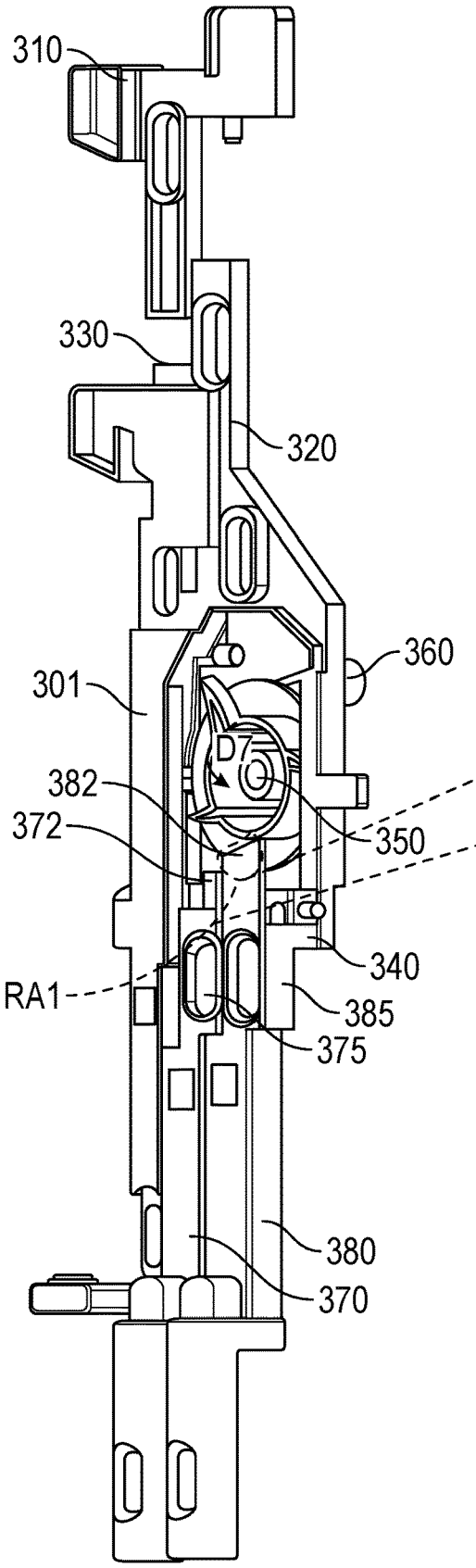
Figure 14B:
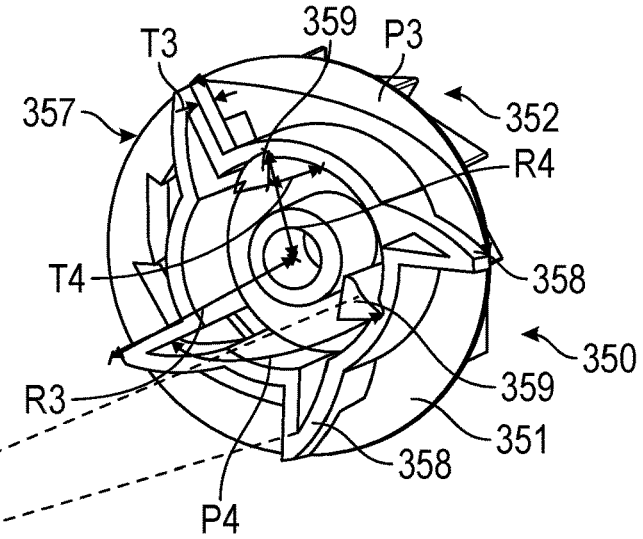
Figure 15:
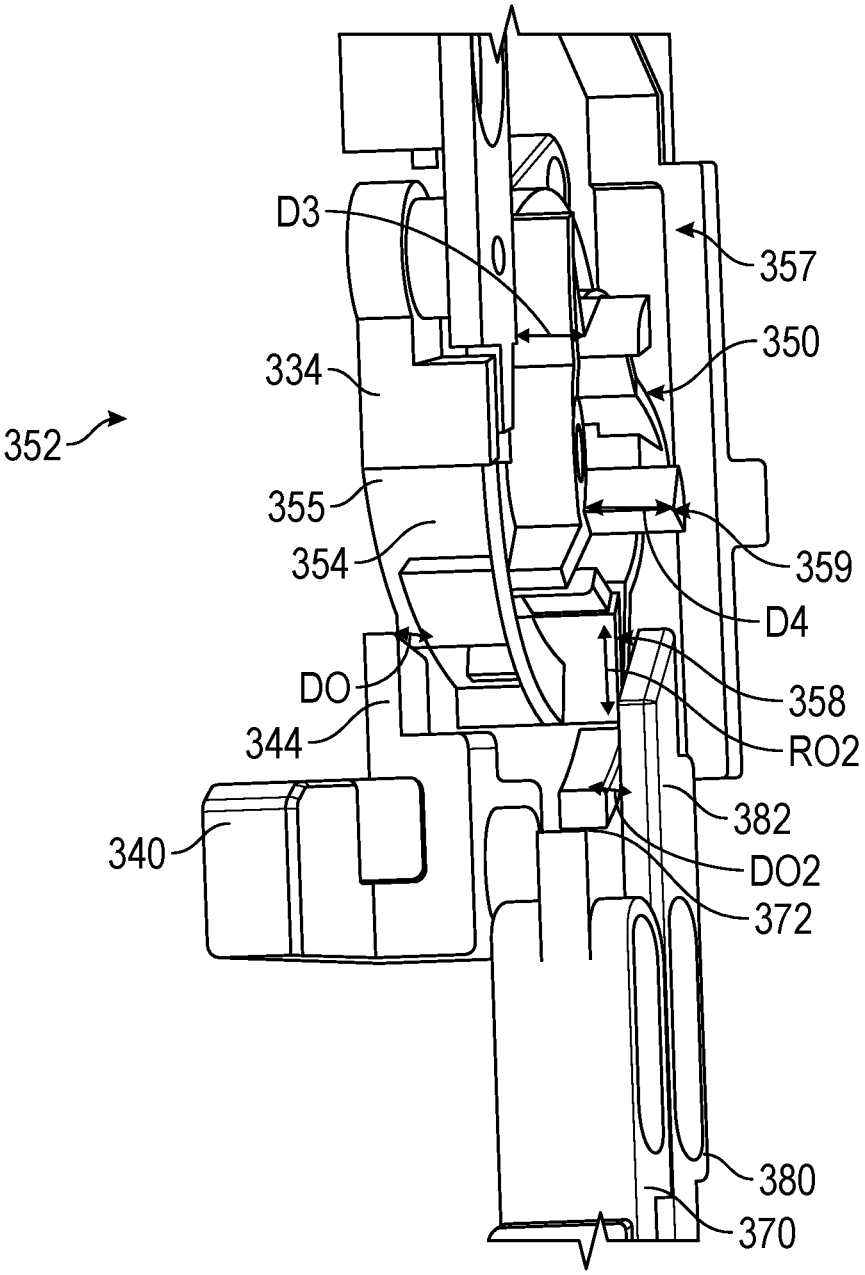
FIG. 15 illustrates a side view of a portion of the actuation mechanism of FIG. 11, the portion including the sequencer of FIGS. 13B and 14B.

Now turning to FIGS. 13A, 13B, 14A, 14B, and 15, in the depicted embodiment, the actuation mechanism 300 selectively causes the multi-action play element 110 to execute different play actions at least because of the structure of the sequencer 350. As is shown, the sequencer 350 includes a main body 351 with: (1) a first side 352 (e.g., a back side) that defines input elements that interact with the input components of the actuation assembly 299 (e.g., actuation cams 334 and 344); and (2) a second side 357 (e.g., a front side) that defines output elements that interact with the output components of the actuation assembly 299 (e.g., lever arms 370 and 380). FIGS. 13A and 13B illustrate the first side 352 while FIGS. 14A and 14B illustrate the second side 357. Additionally, FIG. 15 illustrates a side view that shows depths of various components protruding from the first side 352 and/or the second side 357.

As can be seen in at least FIG. 13B, the first side 352 of the sequencer 350 includes a first set of teeth 354 and a second set of teeth 355. The first set of teeth 354 are positioned radially exterior of the second set of teeth 355. That is, the first set of teeth 354 extend to a maximum radius R1 that is larger than a maximum radius R2 of the second set of teeth 355. Additionally, the first set of teeth 354 are positioned between the second set of teeth 355 and the main body 351 of the sequencer 350. That is, the first set of teeth 354 extend a depth T1 from the main body 351 (e.g., the disk-like base behind the first set of teeth 354 in FIG. 13B) that is less than a depth T2 that the second set of teeth 355 extend from the main body 351.

With these dimensional differences, the first set of teeth 354 can be aligned with a first actuator while the second set of teeth 355 are aligned with a second actuator that is offset from the first actuator in a radial and/or a depth direction. For example, as is illustrated in FIG. 13A (with dashed lines used as geometrical reference lines) and FIG. 15, the first set of teeth 354 can be aligned with the actuation cam 334 of linkage 330 while the second set of teeth 354 are aligned with the actuation cam 344 of the second actuation component 340. In the depicted embodiment, the actuation cam 334 is offset from the actuation cam 344 by a radial offset RO and depth offset DO. However, in other embodiments, a single offset might be sufficient.

Moreover, in the depicted embodiment, the first set of teeth 354 may have a first pitch P1 (i.e., spacing between teeth) that is smaller than a pitch P2 of the second set of teeth 355. The pitch P1 of the first set of teeth 354 and the input components of the actuation mechanism 300 (e.g., actuation components 310 and 320, as well as linkage 330) may be designed so that an actuation of teeth 354 (e.g., by actuation cam 334) advances the sequencer 350 (e.g., in direction D7) a rotational distance approximately equivalent to pitch P1. That is, an actuation of sequencer 350 via the first set of teeth 354 may rotate the sequencer 350 between adjacent teeth of the first set of teeth 354. Thus, each time the actuation assembly 299 actuates the sequencer 350 via teeth 354 (e.g., by actuating actuation cam 334 via the first actuation component 310 or the third actuation component 320), the sequencer 350 may rotate into a new position in which teeth 354 can be actuated again.

On the other hand, the pitch P2 of the second set of teeth 355 and the input components of the actuation assembly 299 (e.g., actuation component 340) may be designed so that an actuation of teeth 355 (e.g., by actuation cam 334) does not advance the sequencer 350 between teeth of second set of teeth 355. Instead, these components may designed to again advance the sequencer 350 (e.g., in direction D7) a rotational distance that is equal to or larger than pitch P1, but smaller than pitch P2. Critically, since the actuation distance achieved from an actuation of the second set of teeth 355 is smaller than the pitch P2 of teeth 355, the second set of teeth 355 will not be in an actuatable position immediately after an actuation of the sequencer 350 via the second set of teeth 355 (e.g., via actuation of second actuation component 340). That is, the sequencer 350 does not rotate a rotational distance approximately equivalent to the pitch P2 of the second set of teeth 355 in response to an actuation of the second set of teeth 355. Thus, the actuator acting on the second set of teeth 355 (e.g., actuation cam 344) will not be aligned with a second tooth of the set of teeth 355 after actuating a first tooth of the set of teeth 355. Instead, after the actuation cam 334 engages a tooth of the second set of teeth 355 and advances the sequencer 350 in direction D7, the rotational limiter 360 may engage a new tooth of the first set of teeth 354 and prevent backwards rotation of the sequencer 350.

Thus, without intervening actuations of a different actuation component, repeated actuations of second actuation component 340 will not repeatedly rotate sequencer 350. Put simply, while each actuation of actuation cam 334 advances sequencer 350 via teeth 354, only select actuations of actuation cam 344 advance the sequencer 350 via teeth 355. However, at a high-level, the sequencer 350 is still configured to be rotated a first amount in response to actuation cam 334 engaging and advancing the first set of teeth 354 (e.g., in response to actuations of the first actuation components 310 or third actuation components 320). Likewise, the sequencer is configured to be rotated a second amount in response to actuation cam 344 engaging and advancing the first set of teeth 355 (e.g., in response to actuations of the second actuation component 340). Preferably, the second amount is larger than the first amount, but in some embodiments, the amounts may be approximately equal.

Next, and as can be seen in at least FIG. 14B, the second side 357 of the sequencer 350 includes one or more first protrusions 358 and one or more second protrusions 359 that each extend from the main body 351. The one or more second protrusions 359 are positioned radially interior of the one or more first protrusions 358. That is, one or more second protrusions 359 extend to a maximum radius R4 that is smaller than a maximum radius R3 of the one or more first protrusions 358. Additionally, the one or more second protrusions 359 extend a depth T4 from the main body 351 (e.g., the disk-like base behind one or more first protrusions 358 in FIG. 14B) that is larger than a depth T3 that the one or more first protrusions 358 extend from the main body 351. Thus, the one or more second protrusions 359 protrude further from the main body 351 than the one or more first protrusions 358.

With these dimensional differences, the one or more first protrusions 358 can be aligned with a first cam while the one or more second protrusions 359 are aligned with at least a second cam that is offset from the first actuator in a radial and/or a depth direction. For example, as is illustrated in FIG. 15, the activation cam 372 of the depicted embodiment is offset from the activation cam 372 by a radial offset RO2 and depth offset D02. Consequently, the one or more first protrusions 358 can be aligned with the activation cam 372 of first lever arm 370 while the one or more second protrusions 359 are aligned with the activation cam 382 of second lever arm 380 or both activation cam 372 and activation cam 382. In fact, in the depicted embodiment, activation cam 372 may also at least partially laterally offset from activation cam 382 (i.e., top ends of cams 372 and 382 may be spaced laterally). Thus, rotations of sequencer 350 over a first rotational distance might actuate cam 382 without actuating cam 372 and rotations of sequencer 350 over a second rotational distance, larger than the first rotation distance, might actuate both cam 382 and actuating cam 372. However, in different embodiments, a radial offset, a lateral offset, or a depth offset might be used alone or in combination with one or more other offsets.

Regardless of the specific offset(s) and/or dimensions used to align protrusions 358 and 359 with cams 372 and/or 382, selective rotations of the sequencer 350 can cause actuations of the multi-action play element 110 via lever arms 370 and 380. In one example, the second lever arm 380 may operate independently while the shoulder 375 of the first lever arm 370 may be configured to engage the seat 385 of the second lever arm 380 and actuate the second lever arm 380 with the first lever arm 370 in response to an actuation of the first lever arm 370 (via actuating cam 372). Thus, rotating a protrusion of the one or more second protrusions 359 through a radial area RA1 in which activation cams 372 and 382 are disposed when in their rest positions (loosely depicted in FIG. 14A) may cause a protrusion 359 to engage and activate actuation cam 382 to actuate lever arm 380 alone (i.e., independently). Meanwhile, rotating a protrusion of the one or more first protrusions 358 through the radial area RA1 may engage and activate actuation cam 372, which, in turn, may actuate lever arm 370 and 380 together (due to the engagement between seat 385 and shoulder 375). Consequently, rotating the one or more first protrusions 358 through the radial area RA1 may release all portions of the multi-action play element 110, for example, to cause the multi-action play element 110 to execute the first play action M1. By comparison, rotating the one or more second protrusions 359 through the radial area RA1 may release only one portion (e.g., second portion 140) of the multi-action play element 110, for example, to cause the multi-action play element 110 to execute the second play action M2.

Notably, in the depicted embodiment, the first actuation component 310 and/or the third actuation component 320 drive(s) rotation of the sequencer 350 a first rotational amount via the first set of teeth 354. This first rotational amount may be sufficient to selectively cause the one or more first protrusions 358 to engage activate actuation cam 372 and cause the multi-action play element 110 to execute the first play action M1 (when activation of cam 372 drives lever arm 370 and lever arm 380). On the other hand, the second set of teeth 355 may be misaligned with the one or more first protrusions 358 so that actuating the second set of teeth 355 with the second actuation component 340 cannot cause the multi-action play element 110 to execute the first play action M1. That is, in some embodiments, only actuations of the first actuation component 310 and/or the third actuation component 320 (via actuator 208 and/or actuator 218) may cause the first play action M1.

Meanwhile, the second actuation component 320 drives rotation of the sequencer 350 a second rotational amount via the second set of teeth 355. This second rotational amount may be sufficient to selectively cause the one or more second protrusions 359 to engage and activate actuation cam 382 and cause the multi-action play element 110 to execute the second play action M2. However, due to pitch sizes of teeth 354 and 355 (described above), in at least some instances, the second actuation component will be unable to drive rotation of the sequencer 350 via the second set of teeth 355 until the first actuation component 310 and/or the third actuation component 320 has "loaded" the sequencer 350 for the actuation cam 344 of the second actuation component 340. That is, in at least some instances, the sequencer 350 must be positioned in a position where the actuation cam 344 of the second actuation component can engage the second set of teeth 355 (i.e., "loaded"). Then, after this loading, the second actuation component 320 can drive rotation of the sequencer 350 via the second set of teeth 355.

Still further, when cam 372 and 382 are offset (in a depth, radial, and/or lateral dimension) and lever arm 380 can move independent of lever arm 370, only actuations of actuation cam 382 may cause the second play action M2. In at least some embodiments, the first set of teeth 354 may be misaligned with the one or more second protrusions 358 so that actuating the first set of teeth 354 with the first actuation component 310 and/or the second actuation component 320 cannot cause the multi-action play element 110 to execute the second play action M2 (since rotating sequencer 350 via teeth 354 cannot cause an actuation of actuation cam 382 alone). That is, in some embodiments, only actuations of the second actuation component 340 (via actuator 228) may cause the second play action M2.

However, to reiterate, the foregoing options are merely examples and other embodiments may arranged these components in various manners to cause different actuations. For example, some input components may cause the sequencer to rotate a first angular amount in direction D7, other input components may cause the sequencer to rotate a second angular amount in direction D7, and the different angular rotations may cause different actuations of the output components in any manner. Additionally or alternatively, a first protrusion may actuate only a first output component and a second protrusion may actuate only a second output component or multiple output components.

As a more specific example, in some instances, one of the one or more protrusions 359 may actuate both cam 372 and cam 382 to release all portions of the multi-action play element 110 to execute the first play action M1 when the sequencer 350 rotates the protrusion through a radial area RA1. On the other hand, if the sequencer 350 rotates a protrusion of the one or more first protrusions 358 through the radial area RA1, the protrusion may actuate only cam 372. Additionally or alternatively, rotating the sequencer 350 a first rotational distance through the radial area RA1 (e.g., in response to an input actuation from actuation cam 334) might actuate cam 372 without actuating cam 382. Meanwhile, rotating the sequencer 350 a second rotational distance through the radial area RA1, larger than the first rotational distance (e.g., in response to an input actuation from actuation cam 344) might actuate both cam 382 and actuating cam 372.

As can be seen in FIG. 14B, in the depicted embodiment, the one or more first protrusions 358 may have a first pitch P3 (i.e., spacing between protrusions) that is smaller than a pitch P4 of the one or more second protrusions 359. However, both pitch P3 and P4 may be larger than the pitches of the teeth included on the first side 352 of the sequencer 350. Thus, only selective actuations of the sequencer (via teeth 354 or 355) may cause protrusions 358 or 359 to actuate activation cam 372 and/or activation cam 382. Moreover, since the pitch P4 of the one or more second protrusions 359 is larger than the pitch P3 of the one or more first protrusions 358, the one or more second protrusions 359 may actuate activation cam 372 and/or activation cam 382 less often than the one or more first protrusions 358. For example, three input actuations of the sequencer 350 might be needed cause the one or more first protrusions 358 to create an actuation (e.g., of activation cam 372 and/or activation cam 382), while five input actuations of the sequencer 350 might be needed cause the one or more second protrusions 359 to create an actuation (e.g., of activation cam 372 and/or activation cam 382).

Additionally, while the depicted embodiment includes four first protrusions 358 and three second protrusions 359, other embodiments might include a different amount of protrusions 358 and/or 359. Similarly, while the depicted embodiment includes protrusions 358 and 359 that are both regularly spaced around the sequencer 350, other embodiments might include different and/or or irregular spacing to create different sequences of selective actuations. Changing the spacing of the protrusions may cause a different pattern of actuations to create a play action.

Figure 16:
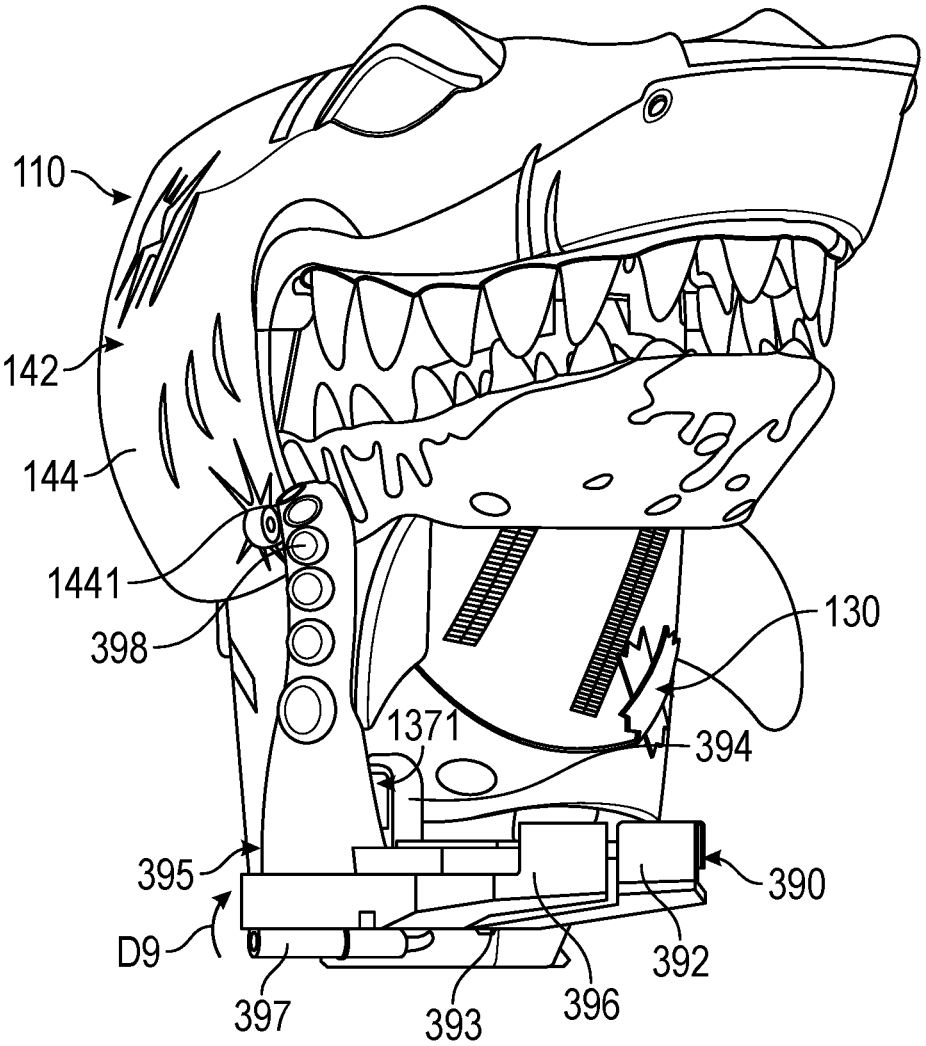
FIG. 16 illustrates a side perspective view of the multi-action play element of FIG. 7 in combination with play element linkages included in the actuation assembly of FIG. 11, according to an example embodiment.

Now turning to FIG. 16, as mentioned, when one or both of activation cams 372 and 382 are actuated, actuated lever arms 370 and 380 actuate play element linkages 390 and/or 395 to cause the multi-action play element 110 to execute a play action. Specifically, when activation cam 372 of the first lever arm 370 is actuated, the first play element linkage 390 rotates in direction D9 and decouples from the flange 1371 of the first portion 120 of the multi-action play element 110. This decoupling frees the first portion 120 (or more specifically, the movable body 130 of the first portion 120) to move in direction D1 (see FIG. 7). Meanwhile, when activation cam 382 of the first lever arm 380 is actuated, the second play element linkage 395 rotates in direction D9 and decouples from the flange 1441 of the second portion 140 of the multi-action play element 110. This decoupling frees the second portion 140 to rotate about axis PA1 in direction D2 and/or about axis PA1 in direction D5 (see FIG. 7).

Thus, if only the second play element linkage 395 is actuated (e.g., when protrusion 359 engages actuation cam 382), the multi-action play element 110 will execute the second play action M2. But, if both the first play element linkage 390 and the second play element linkage 395 are actuated, the multi-action play element 110 will execute the first play action M1. However, in some embodiments, the multi-action play element 110 might also execute a third play action in response to actuation of only the first play element linkage 390. For example, the first portion 120 of the multi-action play element 110 might be able to move in direction D1 without the second portion opening along direction D2 and/or D5. However, such embodiments might utilize a play element linkage that differs from second play element linkage 395 (e.g., play element linkage 395 might be extendable or include an extendable portion).

Figure 18:
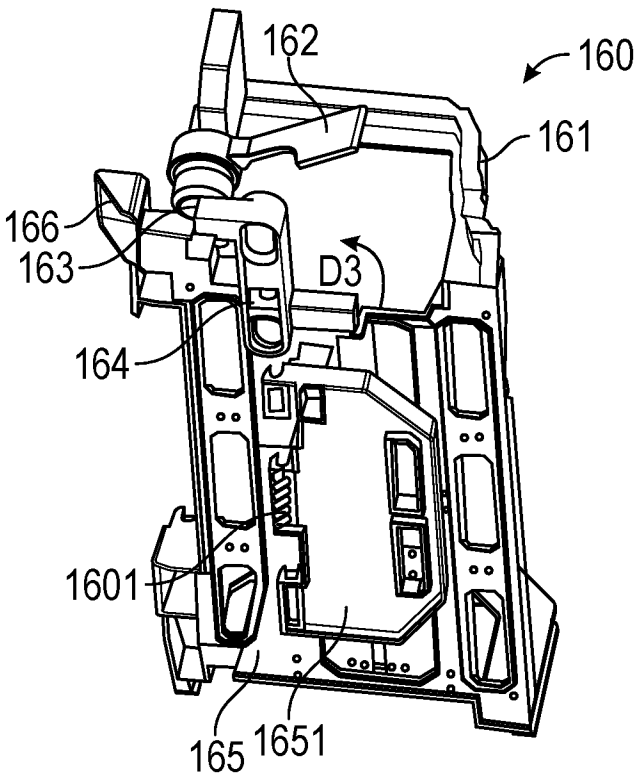
FIG. 18 illustrates a bottom perspective view of a switch assembly included in the actuation assembly of FIG. 11, according to an example embodiment.
Figure 17:
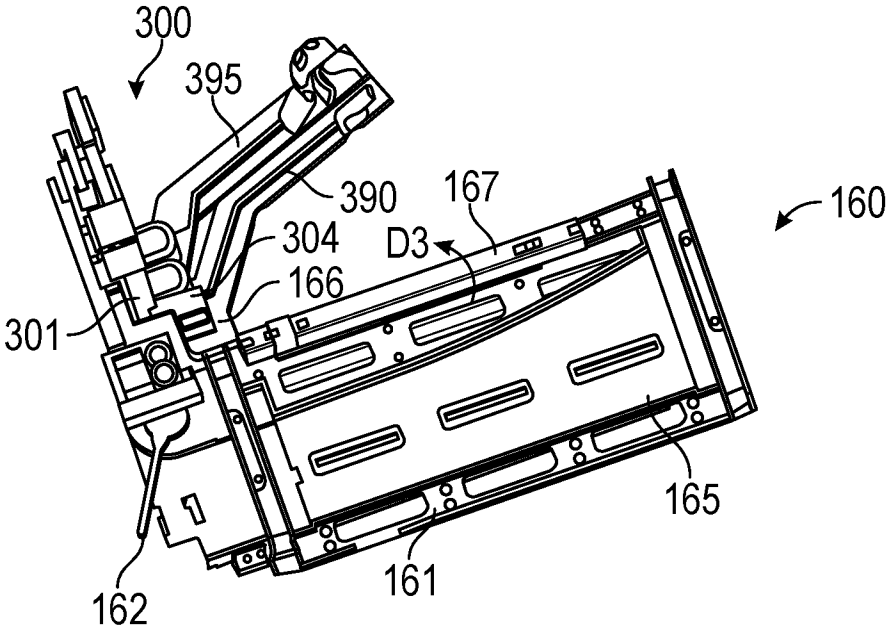
FIG. 17 illustrates a top perspective view of the actuation assembly of FIG. 11.

Now turning to FIGS. 17-18, as mentioned, in at least some embodiments, the actuation mechanism 300 includes a master switch assembly 160. The master switch assembly 160 may be configured to actuate the master switch 301 of the actuation mechanism 300 in a manner that prevents further actuations of the sequencer 350. In some embodiments, such as the depicted embodiment, the master switch assembly 160 may also add play value to a toy vehicle track set, for example, by interacting with toy vehicles that are driving or have driven along trackway 200 or base 100 and/or that have been captured by the multi-action play element 110. In the depicted embodiment, the master switch assembly 160 includes a cage 161 that extends over a track included in or defined by a main body 165 and an actuator 162 disposed at an end of the cage 161. Thus, when a vehicle traverses the track of the main body 165, it may actuate actuator 162.

The cage 161 includes or is connected to an anchor 166 that sits beneath the foot 304 of the master switch 301 of the actuation mechanism 300 (see FIGS. 10 and 17) and holds the foot 304 in place. Meanwhile, as can be seen in FIG. 18, the actuator 162 extends beneath the main body 165 of the master switch assembly 160 and is connected to or includes a cam 163. The cam 163 is positioned to actuate a lock member 164 that holds the main body 165 in a rest position. Once this lock member 164 is actuated, the main body 165 is free to rotate around a rotational joint 167 in direction D3, for example, as driven by a biasing member 1601. In turn, this rotates the anchor 166, which lowers the foot 304 of the master switch 301 in the actuation mechanism 300. In some embodiments, including the depicted embodiment, the main body 165 includes a blocker 1651 and rotation of the main body 165 in direction D3 also rotates the blocker 1651 upwards to unblock a pathway beneath the master switch assembly 160. As an example, FIGS. 5 and 6 illustrate an embodiment where rotating blocker 1651 in direction D3 allows toy vehicles captured by the multi-action play element 110 to escape the toy vehicle track set 10 (in direction D4).

In at least some embodiments, the master switch 301 longitudinally supports at least linkage 330 and the second actuation component 340. That is, the master switch 301 may define longitudinal operational positions for at least the linkage 330 and the second actuation component 340 that align these components with the sequencer 350. Thus, if the master switch 301 is lowered (i.e., in moved in direction D6, as shown in FIG. 12A), the master switch 301 will move the second actuation component 340 out of alignment with the sequencer 350 and prevent the second actuation component 340 (and, thus, actuations of actuator 228) from actuating the sequencer 350.

Likewise, lowering the master switch 301 (i.e., moving master switch 301 in direction D6, as shown in FIG. 12A), may move the linkage 330 out of alignment with the first actuation component 310 and/or the third actuation component 320 so that the actuation assemblies 310 and 320 cannot physically contact linkage 330. Thus, rotating anchor 166 may prevent the first actuation component 310 and/or the third actuation component 320 (and, thus, actuations of actuator 208 and/or actuator 218) from actuating the sequencer 350. Put simply, actuating master switch assembly 160 may "turn off" actuation mechanism 300, thereby "turning off" multi-action play element 110. In some embodiments, lowering the master switch 301 (i.e., moving master switch 301 in direction D6, as shown in FIG. 12A), may also lower any combination of gate 203, gate 222, and bridge 212 so that, in some instances, a toy vehicle can traverse trackway 200 without obstacles (i.e., in an "open play mode"). As a specific example, lowering the master switch 301 (i.e., moving master switch 301 in direction D6, as shown in FIG. 12A), may lower gate 222 and bridge 212 while leaving gate 203 operable by actuator 208. Then, a user can manually release a toy vehicle from the start of the track and watch the toy vehicle traverse the entire track without encountering the bridge 212, the gate 222, or the multi-action play element 110.

Figure 19:
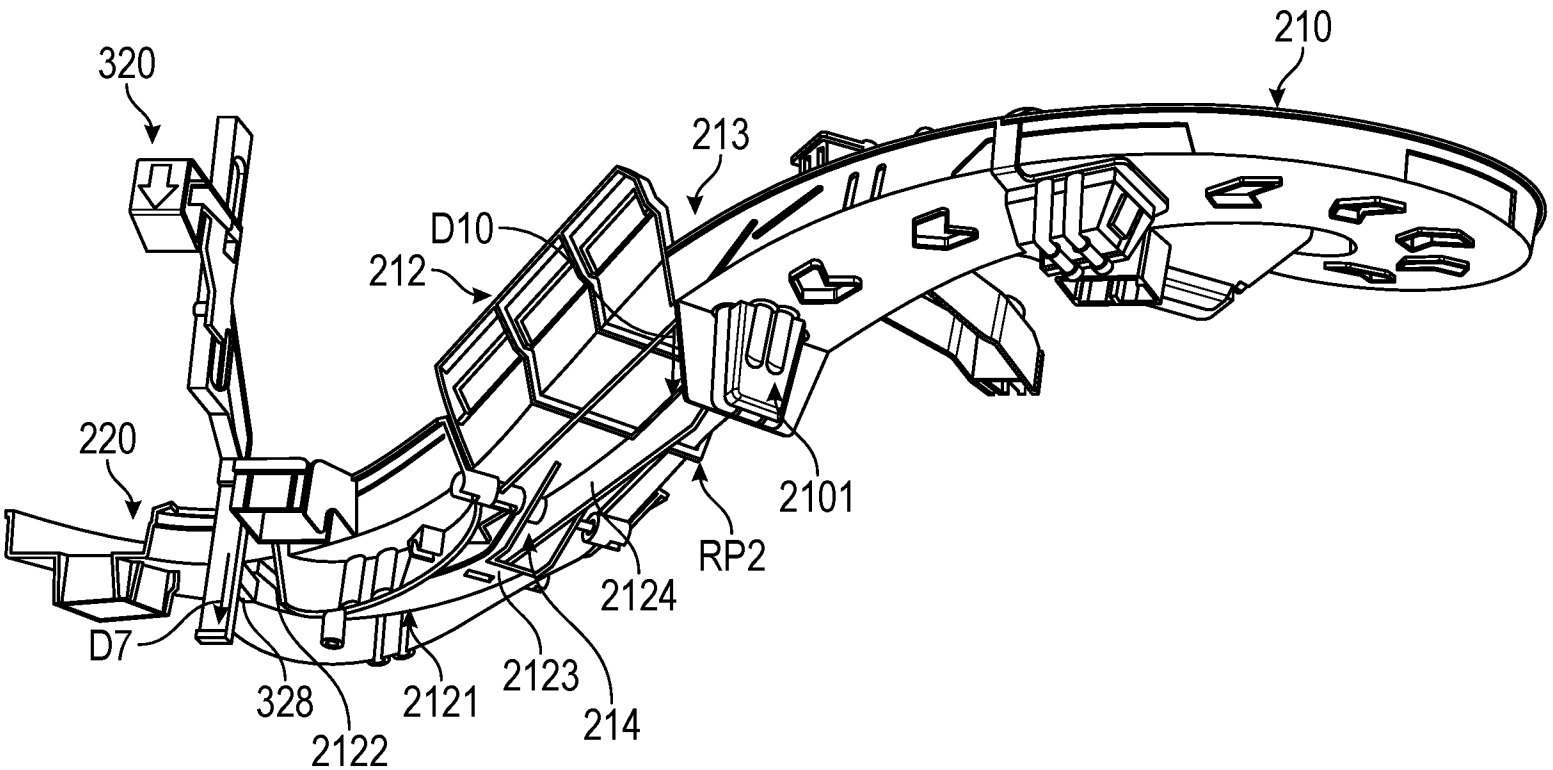
FIG. 19 illustrates a bottom perspective view of a portion of a trackway included in the playset of FIG. 1, the depicted portion including a movable track portion.

Now turning to FIG. 19 for a description of a linkage 2121 that can actuate (e.g., lower) the bridge 212 of the trackway 200 in response to an actuation of actuator 218. As mentioned, this description is representative of a linkage that could be used to couple any actuator of actuation assembly 299 to any gate or trackway feature included in the toy vehicle track set, such as gate 203 and/or gate 222 and, for brevity, each such linkage is not described in detail herein. That said, linkage 2121 extends from a first end 2122 to a second end 2123. The first end 2122 is engaged with the track actuator 328 of the third actuation component 320 and, thus, moves in direction D7 when the third actuation component 320 moves in direction D7.

The linkage 2121 is pivotally coupled to the second stationary track section 220 and, thus, movement of the first end 2122 in direction D7 causes the second end 2123 to move in an opposite direction. Meanwhile, the second end 2123 is disposed above (and potentially biased into a downwards position in this position) a rail 2124 disposed an underside of bridge 212. Consequently, when the second end 2123 rises, the bridge 212 can lower to form a continuous trackway between first stationary track section 210 and second stationary track section 220. That is, the stop 213 can move down in direction D10, removing an impediment between first stationary track section 210 and second movable track portion 212. To accommodate this downward movement, the first stationary track section 210 may include an elongated groove 2101.

Figure 20:
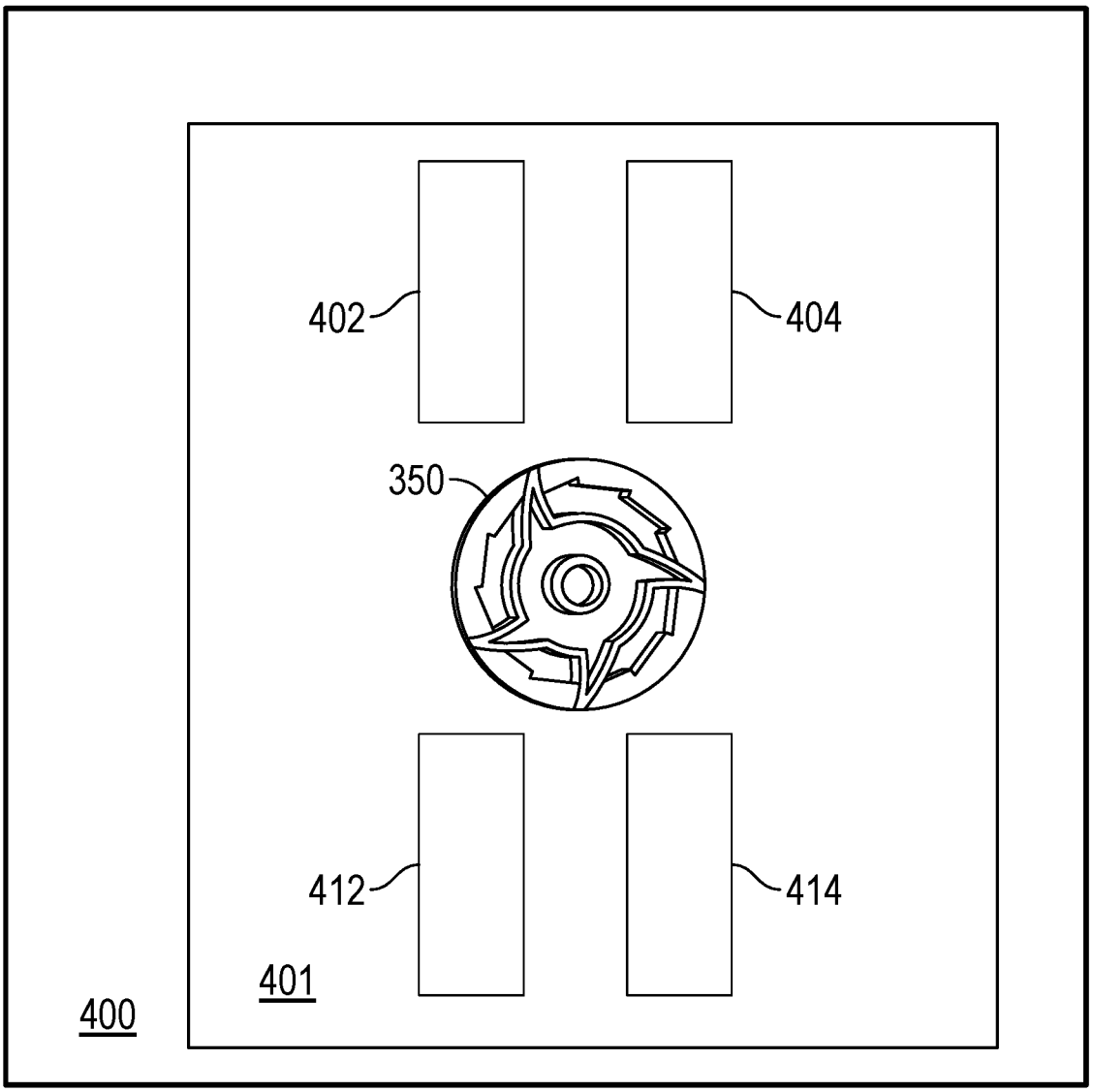
FIG. 20 is a schematic drawing of a toy including the actuation assembly presented herein.

Now turning to FIG. 20, as mentioned, the actuation assembly presented herein need not be used with only a toy vehicle track set and; instead, may be used with any desirable toy, such as toy doll houses, action figure play sets, board games, and so forth. To represent this, FIG. 20 schematically illustrates a toy 400 including an actuation assembly 401. As shown, the actuation assembly 401 includes the sequencer 350 from at least FIGS. 10-15. For brevity, the description of sequencer 350 is not repeated here, but any description of sequencer 350 included in the present application should be understood to apply to the sequencer 350 of FIG. 20. In addition to sequencer 350, actuation assembly 401 includes a first actuation component 402, a second actuation component 404, a first lever arm 412, and a second lever arm 414. These components may have different shapes, sizes, and configurations from like-named components shown in at least FIGS. 10-15; however, the functionality may be the same.

Thus, the sequencer 350 configured to be rotated a first amount in response to actuations of the first actuation component 402 and the sequencer 350 may be configured to be rotated a second amount in response to selective actuations of the second actuation component 404. Then, rotations of the first amount can actuate the first lever arm 412 while rotations of the second amount can actuate the second lever arm 414. Alternatively, rotations of one of the first amount or the second amount could actuate both the first lever arm 412 and the second lever arm 414 (while actuations of the other one of the first amount or the second amount actuate only one of first lever arm 412 and the second lever arm 414). As mentioned, since only some actuations of the first actuation components 402 and 404 will actually cause a rotation of the sequencer 350, actuation assembly 401 can provide random actuations for the toy 400. Alternatively, these components might provide actuations that appear random but are actually sequences (in any desirable sequence).

While the toy vehicle track set and the portions thereof presented herein have has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. That is, it is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy vehicle track set described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

The invention claimed is:

1. An actuation assembly for a toy, comprising:
- a first actuation component;
- a second actuation component;
- a first lever arm;
- a second lever arm; and
- a sequencer configured to be rotated a first incremental amount in response to actuations of the first actuation component and configured to be rotated a second incremental amount in response to selective actuations of the second actuation component, the second incremental amount being different from the first incremental amount, wherein rotations of the first incremental amount can actuate the first lever arm, and wherein rotations of the second incremental amount can actuate the first lever arm and the second lever arm.

2. The actuation assembly of claim 1, wherein the sequencer is two sided and is arranged so that the first actuation component and the second actuation component interact with a first side of the sequencer while the first lever arm and the second lever arm interact with a second side of the sequencer.

3. The actuation assembly of claim 2, wherein the second side of the sequencer comprises:
- a first set of teeth with which the first lever arm interacts; and
- a second set of teeth with which the second lever arm interacts.

4. The actuation assembly of claim 2, wherein the second side of the sequencer comprises:
- one or more first protrusions that can selectively actuate the first lever arm; and
- one or more second protrusions that can selectively actuate the first lever arm and the second lever arm.

5. The actuation assembly of claim 1, wherein:
- an actuation of the first lever arm is configured to cause a multi-action play element to execute a first movement pattern; and
- an actuation of the second lever arm is configured to cause the multi-action play element to execute a second movement pattern.

6. The actuation assembly of claim 3, wherein the first set of teeth are positioned radially exteriorly of the second set of teeth.

7. A toy vehicle track set, comprising:
- a trackway along which toy vehicles can drive, the trackway including at least a portion that is substantially circular so that a side of the trackway at least partially encircles a central opening;
- a first actuator disposed at a first location along the trackway;
- a second actuator disposed at a second location along the trackway;
- a multi-action play element that is extendable and openable, and that is configured to respond to at least some actuations of the first actuator by executing a first play action where the multi-action play element extends and opens so that the multi-action play element rises at least partially through the central opening and interacts with the trackway in a first manner, and respond to at least some actuations of the second actuator by executing a second play action where the multi-action play element opens without extending so that the multi-action play element rises at least partially through the central opening and interacts with the trackway in a second manner; and an actuation assembly including a sequencer that randomly controls which actuations of the first actuator cause the multi-action play element to execute the first play action and randomly controls which actuations of the second actuator cause the multi-action play element to execute the second play action.

8. The toy vehicle track set of claim 7, wherein the trackway includes a movable track portion that extends across the central opening and the multi-action play element is configured to displace the movable track portion when executing the first play action.

9. The toy vehicle track set of claim 8, wherein the multi-action play element does not displace the movable track portion when executing the second play action.

10. The toy vehicle track set of claim 8, wherein the trackway defines a stop adjacent the movable track portion, the stop being configured to temporarily retain a toy vehicle on the trackway until actuation of the first actuator, such that actuation of the first actuator releases the toy vehicle while also selectively causing the multi-action play element to execute the first play action.

11. The toy vehicle track set of claim 7, wherein the multi-action play element moves through the central opening to a first height when executing the first play action and moves through the central opening to a second height, which is smaller than the first height, when executing the second play action.

12. The toy vehicle track set of claim 7, wherein, prior to an actuation, the multi-action play element is disposed in a rest position that connects two portions of the trackway and, subsequent to the actuation, the multi-action play element moves out of the rest position so that the two portions are not connected.

13. The toy vehicle track set of claim 7, further comprising:

a third actuator disposed at a third location along the trackway, wherein the multi-action play element is configured to respond to selective actuations of the third actuator by executing the first play action or a third play action where the multi-action play element interacts with the trackway in a third manner.

14. The toy vehicle track set of claim 13, wherein the trackway extends vertically so that the third location is at a height between a height of the first location and a height of the second location.

15. The toy vehicle track set of claim 7, wherein actuations of the first actuator cannot cause the multi-action play element to execute the second play action and actuations of the second actuator cannot cause the multi-action play element to execute the first play action.

16. A toy vehicle track set, comprising:

a trackway along which toy vehicles can drive, the trackway including at least a portion that is substantially circular so that a side of the trackway at least partially encircles a central opening;

a first actuator disposed at a first height along the trackway;

a second actuator disposed at a second height along the trackway; and a multi-action play element configured to respond to at least some actuations of the first actuator by executing a first play action where the multi-action play element rises at least partially through the central opening and interacts with a toy vehicle disposed on the trackway at or near the first height, and respond to at least some actuations of the second actuator by executing a second play action where the multi-action play element rises at least partially through the central opening and interacts with a toy vehicle disposed on the trackway at or near the second height.

17. The toy vehicle track set of claim 16, further comprising:

an actuation assembly including a sequencer that controls which actuations of the first actuator cause the multi-action play element to execute the first play action and controls which actuations of the second actuator cause the multi-action play element to execute the second play action.

18. The toy vehicle track set of claim 16, wherein the multi-action play element is extendable and openable, the first play action comprises extending and opening, and the second play action comprises opening without extending.

19. The toy vehicle track set of claim 16, further comprising: a third actuator disposed at a third height along the trackway, wherein the multi-action play element is configured to respond to selective actuations of the third actuator by:

executing a third play action where the multi-action play element interacts with vehicles disposed on the trackway at or near the third height; or executing the first play action in a manner that causes the multi-action play element to interact with a toy vehicle disposed on the trackway at or near the third height and a toy vehicle disposed on the trackway at or near the first height.

* * * * *